US005508156A

United States Patent [19]

Kawai

[11] Patent Number: 5,508,156

[45] Date of Patent: Apr. 16, 1996

[54] SILVER HALIDE PHOTOGRAPHIC LIGHT-SENSITIVE MATERIAL

[75] Inventor: Hiroshi Kawai, Minami-ashigara, Japan

[73] Assignee: Fuji Photo Film Co., Minami-ashigara, Japan

[21] Appl. No.: 350,085

[22] Filed: Nov. 29, 1994

[30] Foreign Application Priority Data

Dec. 7, 1993 [JP] Japan ..... 5-306814

[51] Int. Cl.[6] ..... G03C 1/10; G03C 1/09

[52] U.S. Cl. ..... 430/522; 430/505; 430/603; 430/605; 430/963

[58] Field of Search ..... 430/505, 522, 430/963, 603, 605

[56] References Cited

U.S. PATENT DOCUMENTS 4,917,994 4/1990 Martinez et al. ..... 430/543
5,057,405 10/1991 Shiba et al. ..... 430/505
5,238,799 8/1993 Usami et al. ..... 430/522

FOREIGN PATENT DOCUMENTS 62-185755 8/1987 Japan .
5-27353 2/1993 Japan ..... 430/610
5-181240 7/1993 Japan .

*Primary Examiner*—Thorl Chea
*Attorney, Agent, or Firm*—Burns, Doane, Swecker & Mathis

[57] ABSTRACT

There is disclosed a silver halide photographic light-sensitive material. The photographic material comprises a support having thereon at least a silver halide emulsion layer containing silver halide grains, which grains have a silver chloride content of 95 mol % or more and are subjected to selenium, tellurium or gold sensitization, wherein the photographic material further contains a specific dye, and wherein the photographic material preferably has the pH value of the coated film of no more than 6.5.

14 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and particularly to a silver halide photographic light-sensitive material that provides high sensitivity, little reduction of sensitivity upon exposure to light under high humidity, and little remaining color due to ready decoloration during rapid processing. More particularly, the present invention relates to a silver halide color photographic light-sensitive material.

BACKGROUND OF THE INVENTION

Rapid processing is important to a light-sensitive material for prints among a variety of light-sensitive materials. Particularly rapid processing is important to such a product as a light-sensitive material for color prints. That product is used in a market in which there is strong demand for mass production of color prints in a short period of time. Developing time is reduced remarkably by developing a light-sensitive material that contains a silver halide emulsion having a high content of silver chloride. Such rapid processing technology has become popular in the market.

Recently, users can easily obtain prints in a variety of large sizes, such as panorama size and highvision size, in response to user needs. Accordingly, it is still further need to develop new technology for increasing the sensitivity of the light-sensitive material in order to avoid deterioration of the productivity of prints even when the light-sensitive material is exposed to light for such large-size prints.

As an effective method of obtaining high sensitivity, it has been known to use, for a light-sensitive material, a silver halide emulsion that is subjected to chemical sensitization with gold, selenium or tellurium. However, such a light-sensitive material, which contains a silver halide emulsion subjected to chemical sensitization, has the drawback of reduced sensitivity upon exposure to light under high humidity.

To incorporate a metal ion, such as iron and iridium, in a silver halide emulsion, as described in JP-A (JP-A means unexamined published Japanese Patent Application) No. 156452/1991, is effective. However it does not satisfactorily improve the reduction of sensitivity upon exposure to light under high humidity. Extensive investigation was carried out, concentrating on the technical point that the above-mentioned problem of reduced sensitivity might have been caused by a dye that is used for improving sharpness and the like. As a result, some improvement was observed by incorporating, in a light-sensitive material, a finely divided powder compound (as a dye) that is substantially water insoluble at a pH of at least 6 or less and substantially water soluble at a pH of at least 8 or more, as described in JP-A No. 308244/1990. However, the result was not satisfactory with respect to a remaining color due to a residual dye after a rapid processing.

Under such the circumstances, there has been a need to develop a dye that provides a little coloring after rapid processing and that minimizes the reduction of sensitivity upon exposure to light under high humidity when a silver halide emulsion chemically sensitized with gold, selenium or tellurium is used.

SUMMARY OF THE INVENTION

Therefore, an object of the present invention is to provide a silver halide photographic light-sensitive material that provides high sensitivity, little fluctuation of sensitivity caused by a change of humidity upon exposure to light under high humidity, and minimized remaining color due to easy decoloration during rapid processing.

Other and further objects, features, and advantages of the invention will appear more fully from the following description.

DETAILED DESCRIPTION OF THE INVENTION

As a result of intensive investigation, the present inventor has found that the above object can be effectively attained by silver halide photographic light-sensitive materials as set forth below:

(1) A silver halide photographic light-sensitive material comprising, at least, a silver halide emulsion layer on a support, wherein at least one layer of the silver halide emulsion layers contains silver halide grains that have a silver chloride content of 95 mol % or more and are subjected to selenium, tellurium, or gold sensitization, and wherein the photographic material further contains a dye represented by formula (I):

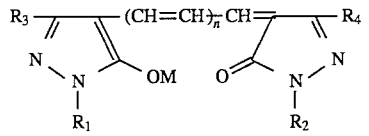

formula (I)

wherein $R_1$, $R_2$, $R_3$ and $R_4$ each represent a hydrogen atom or a substituent, with the proviso that the total atomic weight of at least one of ($R_1$+$R_3$) and ($R_2$+$R_4$) is no more than 160; n is 0, 1 or 2; and M represents a hydrogen atom or an alkali metal.

(2) The silver halide photographic light-sensitive material as stated in the above (1), wherein the above-said silver halide emulsion layer is a cyan, magenta or yellow color-developable layer, and wherein the photographic material contains the above-said dye in a molecular dispersion state.

(3) The silver halide photographic light-sensitive material as stated in the above (1) or (2), wherein none of the substituent $R_1$, $R_2$, $R_3$ and $R_4$ in formula (I) has a dissociating group.

(4) The silver halide photographic light-sensitive material as stated in the above (1), (2) or (3), wherein the pH value of the coated film of the photographic material is no more than 6.5.

(5) The silver halide photographic light-sensitive material as stated in the above (1), (2), (3) or (4), wherein $R_3$ and $R_4$ in formula (I) each stand for a substituent represented by formula (II):

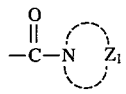

formula (II)

wherein $Z_1$ represents an atomic group required to form a 5- or 6-membered saturated heterocyclic ring with a nitrogen atom.

The present invention is described below in detail.

In the selenium sensitization performed in the present invention, unstable selenium compounds described in, for example, JP-B (JP-B means examined and published Japanese Patent Application) Nos. 13489/1968 and 15748/1969, JP-A Nos. 25832/1992, 109240/1992 and 271341/1992 and EP-0,506,009, can be used. More specifically, examples thereof include colloidal metal selenium, selenoureas (e.g., N,N-dimethylselenourea, trifluoromethylcarbonyl-trimethylselenourea and acetyl-trimethylselenourea), selenoamides (e.g., selenoacetoamide and N,N-diethylphenyl selenoamide), phosphinselenides (e.g., triphenylphosfinselenide and pentafluoropheyl-triphenylphosfinselenide), selenophosphates (e.g., tri-p-tolylselenophosphate and tri-n-butylselenophosphate), selenoketones (e.g., selenobenzophenone), isoselenocyanates, selenocarboxylic acids, selenoesters, and diacylselenides. Furthermore, stable selenium compounds described in JP-B Nos. 4553/1971 and 34492/1977, such as selenious acid, potassium selenocyanate, selenazoles and selenides, can be used.

Unstable tellurium compounds are used in the tellurium sensitization. The unstable tellurium compounds described in, for example, Canadian Patent No. 800,958, British Patent Nos. 1,295,462 and 1,396,696, JP-A Nos. 204640/1992, 271341/1992 and 33043/1991 and Japanese Patent Application No. 129787/1992, can be used.

More specifically, examples thereof include telluroureas (e.g., tetramethyltellurourea, N,N'-dimethylethylenetellurourea, diisopropyl-n-butylphosfintelluride, tributylphosphintelluride, tributoxyphosphintelluride and ethoxydiphenylphosphintelluride), diacyl(di)tellurides (e.g., bis(diphenylarbamoyl)ditelluride, bis(N-phenyl-N-methylcarbamoyl)ditelluride, bis(N-phnyl-N-methylcarbamoyl)telluride and bis(ethoxycarbonyl)telluride), isotellurocyanates, telluroamides, tellurohydrazides, telluroesters (e.g., butylhexyltelluroester), telluroketones (e.g., telluroacetophenone), colloidal tellurium, (di)tellurides and other tellurium compounds (e.g., potassium telluride).

As the specific examples of sensitizer for gold sensitization, use can be made of chloroauric acid, potassium chloroaurate, potassium aurithio cyanate, gold sulfide, gold selenide and other gold compounds, as described in, for example, U.S. Pat. Nos. 2,642,361, 5,049,484 and 5,049,485.

These chemical sensitizers can be used either individually or in combination. It is also preferable to perform the above-described chemical sensitization together with the sulfur sensitization and/or the reduction sensitization. It is desirable that either tellurium sensitization or gold sensitization be employed in the present invention.

In the present invention, the selenium sensitizer or the tellurium sensitizer can be used in an amount of about $10^{-8}$ to $10^{-2}$ mol, preferably about $10^{-7}$ to $10^{-3}$ mol, per mol of silver halide, depending on the type of silver halide grains used and the conditions of the chemical sensitization.

A preferred amount of the gold sensitizer is about $10^{-7}$ to $10^{-2}$ mol per mol of silver halide. Conditions in which the chemical sensitization is performed in the present invention are not particularly restricted, but the pAg value is generally 5 to 9, preferably 6 to 8.5; the pH value is generally 4 to 10; and the temperature is generally 35° to 85° C., preferably 40° to 80° C.

Dyes of formula (I) are described below in detail.

The total atomic weight of at least one of ($R_1$+$R_3$) and ($R_2$+$R_4$) in formula (I) is necessary to be no more than 160, and the total atomic weight of each of them is preferable to be no more than 160. Particularly preferably n is 1.

The substituent $R_1$, $R_2$, $R_3$ and $R_4$ are each preferable to be a member selected from a hydrogen atom, an alkyl group, —$COOR_5$, —$CONR_6R_7$, —$CONHR_8$, —$NR_9COR_{10}$, —$NR_{11}R_{12}$, —CN, —$OR_{13}$ and —$NR_{14}CONR_{15}R_{16}$ ($R_5$ to $R_{16}$ each represents a hydrogen atom or an alkyl group which may be substituted; $R_6$ and $R_7$, $R_{11}$ and $R_{12}$, or $R_{15}$ and $R_{16}$ may form a ring).

Moreover, the substituent $R_1$, $R_2$, $R_3$ and $R_4$ are each more preferable not to have a dissociating group. The dissociating group means a substituent which substantially dissolves in water at 25° C. and more specifically a substituent having the pKa value of 12 or less. As specific examples of such the dissociating group, there recited a sulfonic acid group, a carboxyl group and a phosphoric acid group.

Furthermore, $R_1$ and $R_2$ are each more preferable to be a hydrogen atom or an alkyl group. Preferable examples of the alkyl group include alkyl groups having carbon atoms of 3 or less such as a methyl group, an ethyl group, a propyl group and these groups having a substituent. Preferable examples of such the substituent are those having a non-covalent electron pair such as a hydroxyl group, an ether group, an ester group, a carbamoyl group, a sulfonyl group, a sulfamoyl group and a cyano group. A hydroxyl group and an ether group are particularly preferred.

An alkali metal represented by M is preferable to be Li, Na, K and Cs.

When the substituent $R_3$ and/or $R_4$ are an alkyl group, such the alkyl group is preferable to be a lower alkyl group such as a methyl group, an ethyl group, a propyl group and a butyl group, and the alkyl group may be substituted. Out of these, a methyl group and an ethyl group are particularly preferable.

When the substituent $R_3$ and/or $R_4$ are represented by a —$COOR_5$ group, $R_5$ is preferable to be a lower alkyl group such as a methyl group, an ethyl group, a propyl group and a butyl group, and the alkyl group may be substituted. Among these groups, a methyl group and an ethyl group are particularly preferred.

When the substituent $R_3$ and/or $R_4$ are represented by a —$CONR_6R_7$ group, $R_6$ and $R_7$ each represents a hydrogen atom or an alkyl group, and it is preferred that at least one of $R_6$ and $R_7$ is an alkyl group. The alkyl group is preferable to be a lower alkyl group such as a methyl group, an ethyl group, and a propyl group, and the alkyl group may have a substituent. Preferable examples of such the substituent are a hydroxyl group and an ether group. Moreover, $R_6$ and $R_7$ may be combined to form a ring. Preferable examples of the thus formed ring are 5- or 6-membered nitrogen-containing heterocyclic rings, and a morpholine ring is particularly preferred.

When the substituent $R_3$ and/or $R_4$ are represented by a —$CONHR_8$ group wherein $R_8$ is an alkyl group, the alkyl group has the same meanings as $R_6$ and $R_7$.

When the substituent $R_3$ and/or $R_4$ are represented by a —$NH_9COR_{10}$ group, $R_9$ and $R_{10}$ each represents a hydrogen atom or an alkyl group. The alkyl group is preferable to be a lower alkyl group such as a methyl group, an ethyl group and a propyl group, and a methyl group is particularly preferred. The alkyl group may have a substituent. The substituent is preferable to be a hydroxyl group or an ether group.

When the substituent $R_3$ and/or $R_4$ are represented by a —$NR_{11}R_{12}$ group or a —$OR_{13}$ group, $R_{11}$, $R_{12}$ and $R_{13}$ each represents a hydrogen atom or an alkyl group. Preferable examples of the alkyl group include a methyl group, an ethyl group and a propyl group, and the alkyl group may have a substituent. The substituent is preferable to be a hydroxyl group or an ethyl group. Moreover, $R_{11}$ and $R_{12}$ may be combined together to form a ring. Examples of such the ring are 5- or 6-membered saturated or unsaturated rings.

When the substituent $R_3$ and/or $R_4$ are represented by a —$NR_{14}CONR_{15}R_{16}$ group, $R_{14}$, $R_{15}$ and $R_{16}$ each represents a hydrogen atom or an alkyl group. Preferable examples of the alkyl group include a lower alkyl group such as a methyl group, an ethyl group and a propyl group, and a methyl group is particularly preferred. The alkyl group may have a substituent. Such the substituent is preferable to be a hydroxyl group and an ether group. $R_{15}$ and $R_{16}$ may be combined together to form such a ring as described above.

As the substituent $R_3$ and $R_4$, a —$CONR_6R_7$ group is particularly preferred.

Dyes for use in the present invention preferably exist in coating layers in a molecular dispersion state, such as a single molecule or a dimer. The molecular dispersion state means that a compound represented by formula (I) is approximately uniformly dispersed in emulsion layers and other hydrophilic colloidal layers, and the compound substantially does not exist there in a solid state. Preferably, the compound exists there as a single molecule or a dimer. Since the dyes for use in the present invention are water soluble, they diffuse into all layers during and after the completion of coating of each coating solution.

Specific examples of the compound for use in the present invention are shown below, but the present invention is not restricted to them.

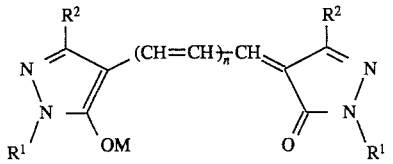

| | $R^1$ | $R^2$ | n | M |
|---|---|---|---|---|
| 1 | H | $CONHCH_2CH_2OH$ | 0 | K |
| 2 | H | $CON(CH_3)_2$ | 1 | K |
| 3 | H | 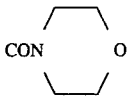 | 1 | K |
| 4 | $CH_3$ | $CONHCH_2CH_2OCH_3$ | 1 | K |
| 5 | $CH_2CH_3$ | $CONHCH_2CH_2OH$ | 1 | K |
| 6 | $CH_2CH_2OH$ | 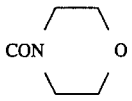 | 1 | K |
| 7 | $CH_2CH_2OH$ | $CONHCH_2CH_2OH$ | 0 | K |
| 8 | $CH_2CH_2OH$ | $CONHCH_3$ | 1 | K |
| 9 | H | $CONHCH_2CH_2OH$ | 1 | K |
| 10 | H | $CON(CH_3)_2$ | 2 | K |
| 11 | $CH_3$ | 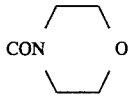 | 1 | Na |
| 12 | $CH_3$ | $CONHCH_2CH_2OCH_3$ | 2 | K |
| 13 | $CH_2CH_3$ | $CONHCH_2CH_2OH$ | 2 | K |
| 14 | $CH_2CH_2OH$ | 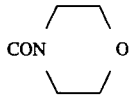 | 2 | K |
| 15 | $CH_2CH_2OH$ | $CONHCH_2CH_2OH$ | 2 | K |
| 16 | $CH_2CH_2OH$ | $CONHCH_3$ | 2 | K |
| 17 | H | $COOC_2H_5$ | 0 | K |
| 18 | H | $COOCH_3$ | 1 | K |
| 19 | $CH_3$ | $COOC_2H_5$ | 1 | Na |

-continued

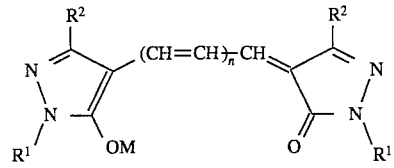

| | $R^1$ | $R^2$ | n | M |
|---|---|---|---|---|
| 20 | $CH_3$ | $COOCH_2CH_2OCH_3$ | 1 | K |
| 21 | $CH_2CH_3$ | $COOC_2H_5$ | 0 | K |
| 22 | $CH_2COOC_2H_5$ | $COOC_2H_5$ | 1 | K |
| 23 | $CH_2CH_2OH$ | $COOC_2H_5$ | 1 | K |
| 24 | H | $COOC_2H_5$ | 1 | K |
| 25 | H | $COOCH_3$ | 2 | K |
| 26 | $CH_3$ | $COOC_2H_5$ | 2 | K |
| 27 | $CH_3$ | $COOCH_2CH_2OCH_3$ | 2 | K |
| 28 | $CH_2CH_3$ | $COOC_2H_5$ | 2 | K |
| 29 | $CH_2COOC_2H_5$ | $COOC_2H_5$ | 2 | K |
| 30 | $CH_2CH_2OH$ | $COOC_2H_5$ | 2 | K |
| 31 | H | CN | 0 | K |
| 32 | H | CN | 1 | K |
| 33 | $CH_3$ | CN | 0 | K |
| 34 | $CH_3$ | CN | 1 | K |
| 35 | $CH_2CH_3$ | CN | 1 | K |
| 36 | $CH_2CH_3$ | CN | 2 | K |
| 37 | H | CN | 2 | K |
| 38 | $CH_3$ | CN | 2 | K |
| 39 | H | $CH_3$ | 1 | K |
| 40 | H | $CH_2CH_3$ | 1 | K |
| 41 | $CH_3$ | H | 1 | Na |
| 42 | $CH_3$ | $CH_3$ | 0 | K |
| 43 | $CH_2CH_3$ | $CH_3$ | 1 | K |
| 44 | $CH_2COOC_2H_5$ | $CH_3$ | 1 | K |
| 45 | $CH_2CH_2OH$ | $CH_3$ | 1 | K |
| 46 | $CH_2CH_2OH$ | $CH_2CH_3$ | 1 | K |
| 47 | H | $CH_3$ | 2 | K |
| 48 | H | $CH_2CH_3$ | 2 | K |
| 49 | $CH_3$ | H | 2 | K |
| 50 | $CH_3$ | $CH_3$ | 2 | K |
| 51 | $CH_2CH_3$ | $CH_3$ | 2 | K |
| 52 | $CH_2COOC_2H_5$ | $CH_3$ | 2 | K |
| 53 | $CH_2CH_2OH$ | $CH_3$ | 2 | K |
| 54 | $CH_2CH_2OH$ | $CH_2CH_3$ | 2 | K |
| 55 | H | $OC_2H_5$ | 1 | K |
| 56 | H | $OC_2H_5$ | 2 | K |
| 57 | $CH_3$ | $OC_2H_5$ | 2 | K |
| 58 | $CH_3$ | OH | 1 | K |
| 59 | $CH_2CH_3$ | $OC_2H_5$ | 2 | K |
| 60 | $CH_2COOC_2H_5$ | $OC_2H_5$ | 2 | K |
| 61 | $CH_2CH_2OH$ | $OC_2H_5$ | 1 | K |
| 62 | $CH_2CH_2OH$ | $OC_2H_5$ | 2 | K |
| 63 | H | $OC_2H_5$ | 0 | K |
| 64 | H | $OCH_2CH_2OH$ | 1 | K |
| 65 | $CH_3$ | $OC_2H_5$ | 0 | K |
| 66 | $CH_3$ | OH | 2 | K |
| 67 | $CH_2CH_3$ | $OC_2H_5$ | 1 | K |
| 68 | $CH_2COOC_2H_5$ | $OC_2H_5$ | 1 | K |
| 69 | $CH_2CH_2OH$ | $OC_2H_5$ | 0 | K |
| 70 | $CH_2CH_2OH$ | $OCH_2CH_2OH$ | 1 | K |
| 71 | H | $NH_2$ | 0 | K |
| 72 | H | $NHCH_2CH_2OH$ | 1 | K |
| 73 | $CH_3$ | $NHCH_2CH_2OH$ | 0 | K |
| 74 | $CH_3$ | $NHCH_2CH_2OH$ | 1 | K |
| 75 | $CH_2CH_3$ | $NHCH_2CH_2OH$ | 1 | K |
| 76 | $CH_2COOC_2H_5$ | $NHCH_2CH_2OH$ | 1 | K |
| 77 | $CH_2CH_2OH$ | $NHCH_2CH_2OH$ | 0 | K |
| 78 | $CH_2CH_2OH$ | $NHCH_2CH_2OH$ | 1 | K |
| 79 | H | $NH_2$ | 1 | K |
| 80 | H | $NHCH_2CH_2OH$ | 2 | K |
| 81 | $CH_3$ | $NHCH_2CH_2OH$ | 2 | K |
| 82 | $CH_3$ | $NH_2$ | 1 | K |
| 83 | $CH_2CH_3$ | $NHCH_2CH_2OH$ | 2 | K |
| 84 | $CH_2COOC_2H_5$ | $NHCH_2CH_2OH$ | 2 | K |
| 85 | $CH_2CH_2OH$ | $NHCH_2CH_2OH$ | 2 | K |
| 86 | $CH_2CH_2OH$ | $NH_2$ | 1 | K |
| 87 | H | $NHCOCH_3$ | 1 | K |
| 88 | H | $NHCOCH_3$ | 2 | K |
| 89 | $CH_3$ | $NHCOCH_3$ | 1 | Na |

-continued

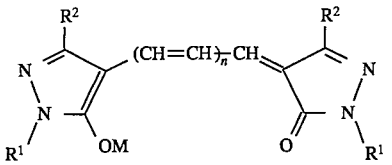

| | $R^1$ | $R^2$ | n | M |
|---|---|---|---|---|
| 90 | $CH_3$ | $NHCOCH_3$ | 2 | K |
| 91 | $CH_2CH_3$ | $NHCOCH_3$ | 1 | K |
| 92 | $CH_2COOCH_3$ | $NHCOCH_3$ | 1 | K |
| 93 | $CH_2CH_2OH$ | $NHCOCH_3$ | 1 | K |
| 94 | $CH_2CH_2OH$ | $NHCOCH_3$ | 2 | K |
| 95 | H | $NHCONHCH_3$ | 0 | K |
| 96 | H | $NHCONHCH_3$ | 1 | K |
| 97 | $CH_3$ | $NHCONHCH_3$ | 0 | K |
| 98 | $CH_3$ | $NHCONHCH_3$ | 1 | K |
| 99 | $CH_2CH_3$ | $NHCONHCH_3$ | 1 | K |
| 100 | H | $NHCONHCH_3$ | 2 | K |
| 101 | H | $NHCON(CH_3)_2$ | 1 | K |
| 102 | $CH_3$ | $NHCONHCH_3$ | 2 | K |
| 103 | $CH_3$ | $NHCON(CH_3)_2$ | 2 | K |
| 104 | $CH_2CH_3$ | $NHCONHCH_3$ | 2 | K |

The compound for use in the present invention can be molecular-dispersed in a light-sensitive layer or a light-insensitive layer according to a variety of known methods. Examples of these methods are a method in which a compound is directly added to a light-sensitive layer or a light-insensitive layer and then dispersed therein; and a method in which a compound is dissolved in a suitable solvent (e.g., methyl alcohol, ethyl alcohol, propyl alcohol, methyl cellosolve; a halogenated alcohol, as described in JP-A No. 9715/1973 and U.S. Pat. No. 3,756,830; acetone, water, pyridine or a mixture of these solvents), and then the thus obtained solution is added to a light-sensitive layer or a light-insensitive layer. The compound used in the present invention is dispersed approximately uniformly through all of the coating layers consisting a photographic material during the coating process, whether such the compound is added to a light-sensitive layer or a light-insensitive layer.

The amount of the compound to be used in the present invention is not particularly restricted, but it is preferable to use the compound in a range of from 0.1 $mg/m^2$ to 200 $mg/m^2$, particularly preferably from 1 $mg/m^2$ to 100 $mg/m^2$ in a photographic material.

The object of the present invention can be attained much more effectively by adjusting the pH value of the coated film of a silver halide photographic light-sensitive material to 6.5 or less. The pH value of the coated film as referred to herein means that of the overall film composed of all the photographic layers to be formed by coating all the necessary coating compositions on a support. Therefore, it does not always correspond to the pH value of the respective coating compositions. The pH value of the coated film can be measured by the method described in JP-A No. 245135/1986, which is as follows:

The method comprises (1) dropping 0.05 cc of pure water onto the surface of the light-sensitive material at the side of silver halide emulsion layers coated on a support, followed by (2) measuring the pH value of the coated film with a film pH-measuring electrode (GS-165F Model, made by Toa Dempa Co.) after 3 minutes.

The light-sensitive material according to the present invention preferably has a pH value of the coated film no more than 6.5, more preferably 4.0 to 6.0, as measured by the above method. If the pH value is too high, fog is apt to increase, which is presumably caused by a change of a dye or a raw emulsion during storage of the light-sensitive material.

The adjustment of the pH value of the coated film can be effected by adding, if desired, an acid (e.g., sulfuric acid, citric acid) or an alkali (e.g., sodium hydroxide, potassium hydroxide) to the coating compositions.

When the light-sensitive material according to the present invention is a color photographic material, it is preferred to coat at least one yellow color-developable silver halide emulsion layer, at least one magenta color-developable silver halide emulsion layer, and at least one cyan color-developable silver halide emulsion layer, on a support having a reflective layer. With a conventional color photographic printing paper, it is possible to reproduce color by a subtractive color process when each silver halide emulsion contains a color coupler that produces a dye of the color complementary to the color of the light to which the emulsion is sensitive. In the conventional color photographic printing paper, silver halide grains in the yellow color-developable silver halide emulsion layer are spectrally sensitized with a blue sensitizing dye; silver halide grains in the magenta color-developable silver halide emulsion layer are spectrally sensitized with a green sensitizing dye; and silver halide grains in the cyan color-developable silver halide emulsion layer are spectrally sensitized with a red sensitizing dye. Furthermore, in the conventional color photographic printing paper, the above-described silver halide emulsion layers may be coated in the order mentioned above, or in a different order. To increase the processing speed, a light-sensitive layer containing silver halide grains having a largest average grain size is preferred to be the uppermost layer. And to enhance the stability of the printing paper kept exposure to light, the magenta color-developable light-sensitive layer should preferably be the lowermost layer.

The light-sensitive layers and their coloring hues may not correspond exactly to the aforementioned order. For instance, at least one layer of an infraredsensitive silver halide emulsion can be used.

In the present invention, it is necessary to use, as silver halide grains in, at least, a silver halide emulsion layer, silver chloride grains, silver chlorobromide grains, or silver chloroiodobromide grains containing 95 mol % or more of silver chloride. In particular, it is preferable to use silver chloride or silver chlorobromide containing substantially no silver iodide, in order to shorten the time required for processing. The phrase "containing substantially no silver iodide" means that the silver iodide content is 1 mol % or less, preferably 0.2 mol % or less. In some case, high-silver-chloride grains containing 0.01 to 3 mol % of silver iodide on the surface of the grain may be used, as described in JP-A No. 84545/1991, for the purpose of enhancing the high illumination sensitivity, the spectral sensitization sensitivity, or the aging stability of the light-sensitive material. The halogen composition of each emulsion may differ or be the same among the grains. When an emulsion whose halogen composition is identical for every grain is used, it is easy to make the grains homogeneous in their properties. Grains whose halogen composition distributions within the grains differ or are the same, may be selected and used, if necessary. Among these grains are so-called uniform-structure grains, whose grains are homogeneous in halogen composition; so-called multi-layered grains, whose grains, formed of a core having a composition and at least one shell surrounding the core, have different compositions; and grains whose non-layered portions have different halogen compositions within or on the surface of the grains (if existing on the grain surface, the non-layer portions are joined at the edges, corners or surfaces). To attain high sensitivity, use of one of the latter two types of grains is preferable over the use of uniform-structure grains. The latter two types of grains are also preferable in view of pressure resistance. If the silver halide grains used are either of the first type mentioned or the second type mentioned, the portions differing in halogen composition may have distinct boundaries or indistinct boundaries wherein a mixed crystal is formed due to different compositions. Alternatively, each grain of the latter two types may have a continuously changing composition.

Preferably, the high-silver-chloride emulsions contain silver halide grains having the afore mentioned layered or non-layered localized phase of silver bromide on the surface and/or inside of the grain. These localized phases have a halogen composition whose silver bromide content is preferably at least 10 mol %, more preferably exceeding 20 mol %. The silver bromide content of each localized phase can be analyzed by means of an X-ray diffraction method or the like. (The X-ray diffraction method is described in, for example, Japan Chemical Society, "New Experimental Chemistry Lecture 6: Structure Analysis," Maruzen.) These localized phases may exist within the grains, at their edges, at their corners, or on their surfaces. One desirable example is grains with these localized phases epitaxially grown on the grain corners.

The rate of replenishing the developing solution can be effectively reduced by further increasing the silver chloride content of the silver halide emulsions. In this case, the preferably used emulsions are ones containing silver halide that is almost exclusively silver chloride; that is, containing 98 mol % to 100 mol % of silver chloride.

The average grain size of the silver halide grains contained in the silver halide emulsions used in the present invention is preferably 0.1 μm to 2 μm. (The term "average grain size" means the arithmetic mean of the sizes of the individual grains, and each grain size is the diameter of a circle equivalent to the projected area of the individual grain.)

Desirably these grains are so-called monodisperse grains that have a size distribution in terms of a variation coefficient of 20% or less, preferably 15% or less, and more preferably 10% or less. ("Variation coefficient" is a value obtained by dividing the standard deviation of grain size by the average grain size.) In order to impart a broad latitude to the light-sensitive material, it is preferable to use the monodisperse emulsions blended together in the same layer or used in the multilayers coated adjacent to each other.

The shape of silver halide grains contained in the photographic emulsion may have regular crystals, such as cubic, tetradecahedral or octahedral crystals; or irregular crystals, such as spherical crystals and tabular crystals; or a mixture of regular and irregular crystals. Furthermore, the grains may consist of a mixture of grains having various crystal shapes. In the present invention, desirably 50% or more, preferably 70% or more, and more preferably 90% or more, of the grains are grains having regular shapes.

In addition, other emulsions, whose tabular grains, having an average aspect ratio (i.e., the equivalent-sphere diameter/thickness ratio) of 5 or more, preferably 8 or more, occupy 50% or more to the projected area of all grains contained, can be used.

The silver chloride (bromide) emulsion for use in the present invention can be prepared with the method described in, for example, P. Glafkides, "Chemie et Phisique Photographique," Paul Montel, 1967, G. F. Duffin, "photographic Emulsion Chemistry," Focal Press, 1966; and V. L. Zelikman et al., "Making and Coating Photographic Emulsion," Focal Press, 1964. Specifically, the emulsions can be prepared with an acid method, a neutral method, or an ammonia method. To react a soluble silver salt and a soluble halogen salt, any of a single-Jet method, a double-jet method, or a combination of these methods can be used. Also, a method (known as "reverse double-jet method") may be employed in which grains are formed in the presence of excess silver ions. As one type of the double-jet method, the so-called controlled double-jet method may be used, in which pAg in the silver halide-forming liquid phase is maintained at a constant value. This method can produce a silver halide emulsion containing grains that have a regular shape and that are nearly uniform in size.

The localized phase in silver halide grains or the substrate of the phase preferably contains metal ions different from silver or complex ions thereof. The preferred ions are those of the VIII group and IIb group metals of the periodic table, complex ions thereof, lead ions, and thallium ions. Mainly in these localized phases, ions of iridium, rhodium, or ion, or complex ions thereof, may be used singly or in combination. Mainly in the substrate of the phase, ions of osmium, iridium, rhodium, platinum, ruthenium, palladium, cobalt, nickel or iron, or complex ions thereof, may be used singly or in combination. It is possible to use metal ions in a different concentration and a different kind thereof between in the localized phase and the substrate. Furthermore, these metals may consist of a mixture of metals. It is particularly desirable that an iron compound and an iridium compound exist in the localized phase of silver bromide.

These metal ion-providing compounds are doped into the localized phase and/or the other portion (i.e., substrate) of silver halide grains used in the present invention, by dissolving these compounds in a gelatin aqueous solution, a halide aqueous solution, a silver salt aqueous solution, or some other aqueous solution, which solution is used as a dispersant. These compounds are also doped by adding fine silver halide grains containing metal ions to such an aqueous solution, and then dissolving these fine grains in the solution during a formation of the silver halide grains.

The metal ions for use in the present invention may be contained in the emulsion grains by adding them in a reactor before the grains are formed, during a grain formation, or immediately after the grains have been formed. The timing of the metal ions being introduced into each grain is determined in-accordance with where in the grain the ions should be located.

The silver halide emulsions for use in the present invention may be subjected to an ordinary chemical sensitization in combination with the above mentioned selenium, tellurium, or gold sensitization, and to an ordinary spectral sensitization. Preferred compounds used in the chemical sensitization are those described in JP-A No. 215272/1987, page 18, lower-right column, to page 22, upper-right column.

The emulsions for use in the present invention are of the so-called surface latent-image type, in which a latent image is mainly formed on the surface of each grain.

Various compounds and precursors thereof can be added to the silver halide emulsions used in the present invention, in order to prevent fog from occurring while the light-sensitive material is being manufactured, stored, or processed, or to stabilize photographic properties. As specific examples thereof, the compounds disclosed in JP-A No. 215272/1987, pages 39 to 72, may be preferably used. Also, 5-arylamino-1,2,3,4-thiatriazole compounds, as described in EP-0,447,647 (having at least one electron-attractive group at the aryl residual group), may be preferably used.

Spectral sensitization is performed for the purpose of imparting spectral sensitivity to the emulsion for each layer in the light-sensitive material of the present invention, so that the emulsion may be sensitive to a desired wavelength region of light.

Spectral sensitizing dyes that can be used to effect blue-, green- and red-region spectral sensitization in the light-sensitive material of the present invention are described, for example, in F. M. Hamer, "Heterocyclic Compounds—Cyanine Dyes and Related Compounds," John Wiley & Sons, New York, London, 1964. Specific examples of these compounds, and the spectral sensitization method, that are preferably utilzied, are described in JP-A No. 215272/1987, page 22, upper-right column, to page 38. In particular, in view of stability, adsorbability, and dependency on an exposure temperature, the spectral sensitizing dyes disclosed in JP-A No. 123340/1991 are very much preferable as a red-sensitive spectral sensitizing dye for silver halide emulsion grains that have a high-silver-chloride content.

In order to perform an infrared-region spectral sensitization with high efficiency in the light-sensitive 10 material of the present invention, sensitizing dyes that are preferably used are those described in JP-A No. 15049/1991, page 12, upper-left column, to page 21, lower-left column; in JP-A No. 20730/1991, page 4, lower-left column, to page 15, lower-left column; in EP-0,420,011, page 4, line 21, to page 6, line 54; in EP-0,420,012, page 4, line 12, to page 10, line 33; in EP-0,443,466; and in U.S. Pat. No. 4,975,362.

To introduce these spectral sensitizing dyes into the silver halide emulsions, the dyes may be dispersed directly into the emulsions, or they may be first dissolved in a solvent, such as water, methanol, ethanol, propanol, methyl cellosolve, 2,2,3,3-tetrafluoro-propanol, or the like, or in a mixture of such solvents, and then added, as the resultant solution, to the emulsions. Alternatively, the dyes may be dissolved together with an acid or a base in water, thus forming an aqueous solution, which may be added to the emulsions, as is described in JP-B Nos. 23389/1969, 27555/1969, 22089/1982 and the like. As a further alternative, the dyes may be dissolved together with a surfactant, thus forming an aqueous solution or a colloidal dispersion, and the solution or the dispersion may then be added to the emulsions, as is described in U.S. Pat. Nos. 3,822,135, 4,006,025 and the like. Also, the dyes may be dissolved in a solvent, such as phenoryethanol, which substantially does not mix with water, and then be dispersed into water or a hydrophilic colloid, thereby forming a dispersion, which may be added to the emulsions. Still further, the dyes may be directly dispersed into hydrophilic colloid, and the resultant dispersion may be added to the emulsions, as is described in JP-A Nos. 102733/1978 and 105141/1983. The dyes can be added to the emulsions at any stage in the preparation of emulsions, which stage is known to be useful. In other words, the dyes can be added at any time during the preparation of the coating solutions; that is, before the formation of emulsion grains, during the formation of emulsion grains, immediately after the grain formation and before the washing of the grains formed, before the chemical sensitization of grains, during the chemical sensitization of the grains, or immediately after chemical sensitization and before the cooling-solidification of the chemically sensitized emulsions. In most cases, they are added after the chemical sensitization and before the coating of solutions. However, the dyes can be added along with the chemical sensitizer to perform the spectral sensitization simultaneously with the chemical sensitization, as is described in U.S. Pat. No. 3,628,969 and U.S. Pat. No. 4,225,666. Alternatively, they can be added prior to the chemical sensitization, as is described in JP-A No. 113928/1983, or they can be added before the precipitation of the silver halide grains to initiate spectral sensitization. Furthermore, as is described in U.S. Pat. No. 4,225,666, the spectral sensitizing dyes may be added in two successive parts, respectively before and after the chemical sensitization. The dyes can be added at any time during the formation of silver halide grains, as in the method described, for example, in U.S. Pat. No. 4,183,756. It is particularly preferable to add the sensitizing dye before the washing of the emulsions or before the chemical sensitization.

The amount of these spectral sensitizing dyes to be added ranges broadly, but it is preferably $0.5\times10^{-6}$ to $1.0\times10^{-2}$ mol per mol of silver halide, more preferably $1.0\times10^{-6}$ to $5.0\times10^{-3}$ mol per mol of silver halide.

When sensitizing dyes spectrally sensitive from the red region to the infrared region are used in the present invention, they are preferably used together with the compounds described in JP-A-157749/1990, page 13, lower-right column, to page 22, lower-right column. The use of these compounds can enhance the storage stability, processing stability, and supersensitization of the light-sensitive material, specifically. It is particularly preferable to use the compounds represented by the formulae (IV), (V) and (VI) described in JP-A-157749/1990, along with the spectral sensitizing dyes. These compounds are used in an amount of $0.5\times10^{-5}$ to $5.0\times10^{-2}$ mol per mol of silver halide, preferably $5.0\times10^{-5}$ to $5.0\times10^{-3}$ mol per mol of silver halide. Their effective amount lies within a range of 0.1 to 10,000, preferably 0.5 to 5,000, in molar ratio to the sensitizing dyes.

The light-sensitive material of the present invention is preferable for processing not only in a print system using an ordinary negative printer, but also in a digital scanning-exposure system. The digital scanning-exposure system employs monochromatic high-intensity light emitted from a gas laser, a light emitting diode, a semiconductor laser, or a second-harmonic generating (SHG) light source, i.e., a combination of a nonlinear optical crystal with a semiconductor laser or a solid-state laser comprising a semiconductor laser used as excitation light source. A semiconductor laser, or a second-harmonic generating (SHG) light source, i.e., a combination of a nonlinear optical crystal with a semiconductor laser or a solid state laser, is preferably used to make the system compact and inexpensive. Particularly, a semiconductor laser is preferably used to design an apparatus that is compact, inexpensive, durable, and highly reliable. It is desirable that a semiconductor laser be used as at least one of the exposure light sources.

Using the scanning-exposure light source of this type, the maximum spectral sensitivity can be set at any desired value for the light-sensitive material of the present invention, in accordance with the wavelength of the light emitted from the scanning-exposure light source. The SHG light source, made by combining a nonlinear optical .crystal with a semiconductor laser or a solid-state laser comprising a semiconductor laser used as excitation light source, can reduce to half the oscillation frequency of the laser and can, therefore, apply blue light and green light. Hence, it is possible to set the maximum spectral sensitivity in the three ordinary light régions, i.e., blue, green and red regions. The use of a semiconductor laser as a light source makes a device inexpensive, reliable and compact. Therefore it is preferred that at least two layers of the light-sensitive material have their maximum spectral sensitivities at wavelengths of 670 nm or more. This is, because the III–V group-series semiconductor laser available at present, inexpensive and stable has its emission wavelength in the red and infrared region only.

Laboratory experiments have proved that a II–VI group-series semiconductor laser emits light at wavelengths in the green or blue region. It is well expected that semiconductor lasers capable of reliably emitting light at wavelengths in the green or blue region will be available at low prices when the technology of manufacturing semiconductor lasers advances. Then, it will be less of a requirement that at least two layers of the light-sensitive material have their maximum spectral sensitivities at wavelengths of 670 nm or more.

In the case of such a scanning-exposure process, the time for which the silver halide in the light-sensitive material is exposed is the time required for exposing a very small area. That area is generally known as a picture element. The very small area generally used is a minimum unit that controls the amount of light from each of digital data. The exposure time per picture element therefore depends on the size of the picture element. The size of picture element depends on the picture element density, which is, in practice, 50 to 2,000 dpi (dots per inch). Assuming that the picture element density is 400 dpi, the exposure time that is required to exposure to light of such the picture size is preferably $10^{-4}$ second or less, more preferably $10^{-6}$ second or less.

Preferably, dyes (particularly, oxonol dye or cyanine dye) described in EP-0,337,490A2, pages 27 to 76, which are capable of being decolored when processed, are added to the hydrophilic colloid layers of the light-sensitive material according to the present invention, in order to prevent irradiation or halation and to enhance safelight stability.

Among these water-soluble dyes are those that may cause color separation or may impair safelight stability, according to the increase of amount to be used. Preferable dyes that do not impair the color separation when used are water-soluble dyes described in EP-0,539,978A1 and JP-A Nos. 127325/1993 and 127324/1993.

In the present invention, colored layers that can be decolored when processed are used with the water-soluble dyes. These colored layers may directly contact the emulsion layers or may be formed on interlayers containing a color mixing-preventing agent, such as gelatin and hydroquinone. Preferably, the colored layers are arranged beneath (that is, closer to the support than) the emulsion layers that provide primary colors similar to their colors. Colored layers may be provided for all primary colors, or just for some of the primary colors. Alternatively, a single colored layer containing a mixture of different colors each corresponding to the primary colors, can be used. Desirably each colored layer has an optical reflection density of 0.2 or more to 3.0 or less, preferably 0.5 or more to 2.5 or less, and more preferably 0.8 or more to 2.0 or less, when exposed to light of wavelength at the highest optical density (i.e., visible light region of 400 nm to 700 nm in the case of the ordinary printer exposure, or the wavelength of light from a scanning-exposure light source, in the case of scanning exposure).

The colored layers can be formed by the conventional methods. An example is the method in which the dyes disclosed in, for example, JP-A No. 282244/1990, page 3, upper-right column, to page 8, and JP-A No. 7931/1991, page 3, upper-right column, to page 11, lower-left column, are dispersed in the form of solid fine grains, into hydrophilic colloid layers. Another example is the method in which an anionic dye is mordanted into cation polymer. Still another example is the method in which a dye is adsorbed into the fine grains of silver halide or the like, thus fixing the dye in the layers. A further example is the method disclosed in JP-A No. 239544/1989, in which colloidal silver is utilized. A method of dispersing dyes into hydrophilic colloid layers, in the form of solid fine grains, is described in JP-A No. 3082244/1990, pages 4 to 13. In this method, a fine-grain dye that is substantially water-insoluble at pH 6 or less, but substantially water-soluble at pH 8 or more, is used. A method of mordanting an anionic dye into cation polymer is described in JP-A No. 84637/1990, pages 18 to 26. Methods of preparing colloidal silver for use as a light absorbent are disclosed in U.S. Pat. No. 2,688,601 and U.S. Pat. No. 3,459,563. Of these methods, the preferable ones are the method of dispersing fine dye grains into hydrophilic colloid layers, and the method of using colloidal silver.

Gelatin is useful as a binder or protective colloid that can be used in the light-sensitive material according to the present invention. Nonetheless, hydrophilic colloid other than gelatin can be used, either by itself or in combination with gelatin. Preferable for use in the present invention is low-calcium gelatin that attain 800 ppm or less, preferably 200 ppm or less of total calcium in the light-sensitive material. It is also preferable to add an antifungal agent, of the type disclosed in JP-A-271247/1988, to the hydrophilic colloid, in order to prevent fungi or germs from breeding in the hydrophilic colloid layers, and thereby to avoid deterioration of the dye image.

It is desirable to use the band-stop filter described in U.S. Pat. No. 4,880,726, in subjecting the light-sensitive material of the present invention to printer exposure. The use of this filter prevents color mixing of light used for exposure, and thereby color reproduction is markedly improved.

After being exposed to light, the light-sensitive material is color developed in the generally practiced way. For the color light-sensitive material of the present invention, it is preferable to perform bleach fixing after color development, for the purpose of increasing the processing speed. Particularly when high-silver-chloride emulsions are used, the pH value of the bleach fixing solution is preferably about 6.5 or less, more preferably about 6 or less, in order to accelerate desilverization.

Preferably, the silver halide emulsions and other substances (additives and the like) for use in the light-sensitive material of the present invention, the photographic layers (or layer arrangement) of the material, the methods of processing the material, and the additives for use in processing the material, are those that are described in EP-0,355,660A2 (i.e., JP-A No. 139544/1990) and that are shown in the following Table 1.

TABLE 1

| Element constituting photographic material etc. | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line | p. 28 upper right column line 16 to p. 29 lower right column line 11 and p. 30 lines 2 to 5 | p. 45 line 53 to p. 47 line 3 and p. 47 lines 20 to 22 |

TABLE 1-continued

| Element constituting photographic material etc. | JP-A No. 215272/1987 | JP-A No. 33144/1990 | EP 0,355,660A2 |
|---|---|---|---|
| | 4 from the bottom to p.13 upper left column line 17 | | |
| Solvent for silver halide | p. 12 lower left column lines 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 33 last line | p.3 0 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 lower left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 from the bottom | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active | p. 201 lower left column line 1 to p. 210 upper | p. 18 upper right column line 1 to p. 24 lower right | — |

TABLE 1-continued

| Element constituting photographic material etc. | JP-A No. 215272/1987 | JP-A No. 33144/1990 | EP 0,355,660A2 |
|---|---|---|---|
| agent | right column last line | column last line and p. 27 lower left column line 10 from the bottom to lower right column line 9 | |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p.39 upper left column line 4 to p. 42 upper left column last line | p. 67 line 14 to p. 69 line 28 |

Note: In the cited part of JP-A No. 215272/1987, amendment filed on March 16, 1987 is included. Further, among the above-mentioned color couplers, it is preferred to use so called a short wavelength-type yellow coupler, described in JP-A Nos. 231451/1988, 123047/1988, 241547/1988, 173499/1989, 213648/1989, and 250944/1989, as a yellow coupler.

Desirably the cyan, magenta and yellow couplers are impregnated in a loadable latex polymer (for example, the one disclosed in U.S. Pat. No. 4,203,716). They are alternatively dissolved together with a water-insoluble, organic solvent-soluble polymer. The impregnation and the alternative dissolving are carried out in (or not in) the presence of the high-boiling organic solvents shown in the above table. Then the resulting mixture is subjected to an emulsion dispersion in a hydrophilic colloid aqueous solution. Preferable water-insoluble, organic solvent-soluble polymers that may be used are the homopolymers or copolymers described in U.S. Pat. No. 4,857,449, columns 7 to 15, and PCT International Publication WO 88/00723, pages 12 to 30. More preferable are methacrylate-series polymers and acrylamide-series polymers. In particular, the use of acrylamide-series polymers is desirable, since they help to enhance color-image stability.

In the light-sensitive material according to the present invention, it is desirable to use, together with couplers, compounds of the type disclosed in EP-0,277,589A2, in order to improve the color-image storage stability of the material. Such compounds are preferably used with pyrazoloazole couplers and pyrrolotriazole couplers.

More specifically, a compound disclosed in the above patent, which chemically bonds with an aromatic amine-based developing agent remaining after the color development, to form a chemically inactive and substantially colorless compound, and/or another compound disclosed in the above patent, which chemically bonds with an oxidized form of an aromatic amine-based developing agent remaining after the color development, to form a chemically inactive and substantially colorless compound, can be preferably used simultaneously or independently, in order to prevent stain or other side effects from occurring after processing. The stain or other side effects are due to the coloring dye formed by the reaction between the coupler and the residual developing agent in film or the oxidized form of the developing agent.

Examples of the cyan couplers that are preferably used are a diphenylimidazole-based cyan coupler disclosed in JP-A No. 23144/1990; a 3-hydroxypyridine-based cyan coupler disclosed in EP-0,333,185A2 (particularly preferable are the couplers (6) and (9), and a two-equivalent coupler prepared by bonding a chlorine leaving group to the four-equivalent coupler exemplified as (42)); a cyclic active methylene-based cyan coupler described in JP-A No. 32260/1989 (particularly preferable are the couplers exemplified as 3, 8, and 34); a pyrrolopyrazole-type cyan coupler disclosed in EP-0,456,226A1; a pyrroloimidazole-type cyan coupler disclosed in EP-0,484,909; and a pyrrolotriazole-type cyan coupler described in EP-0,488,248 and EP-0,491,197A1. Of these couplers, the pyrrolotriazole-type cyan coupler is particularly preferred.

Examples of the yellow couplers that are preferably used, in addition to the compounds shown in the above table, are an acylacetoamide-type yellow coupler disclosed in EP-0,447,969A1, which has a 3- to 5-membered cyclic structure in the acyl group; a malondianilide-type yellow coupler described in EP-0,482,552A1, which has a cyclic structure; and an acylacetoamide-type yellow coupler described in U.S. Pat. No. 5,118,599, which has a dioxane structure. Of these couplers, particularly preferable are an acylacetoamide-type yellow coupler whose acyl group is 1-alkylcyclopropane-1-carbonyl group, and a malondianilide-type yellow coupler in which one of the anilides forms an indoline ring. These couplers can be used either singly or in combination.

The magenta couplers for use in the present invention are such 5-pyrazolone-based magenta couplers and pyrazoloazole-based magenta couplers as are described in the references specified in the above table. Of these couplers, preferable in terms of hue, image stability, and coloring property, are a pyrazolotriazole coupler disclosed in JP-A No. 65245/1986, in which a secondary or tertiary alkyl group directly bonds at the second, third, or sixth position of the pyrazolotriazole ring; a pyrazoloazole coupler described in JP-A No. 65246/1986, which has a sulfonamide group in a molecule; a pyrazoloazole coupler described in JP-A No. 147254/1986, which has an alkoxyphenylsulfonamido ballast group; and a pyrazoloazole coupler disclosed in EP-0, 226,849A and EP-0,294,785A, which has an alkoxy group or an aryloxy group at the sixth position of the pyrazoloazole ring.

Preferable processing materials and methods, other than those specified in the above table, which can be employed to process the color light-sensitive material of the present invention, are described in JP-A No. 207250/1990, page 26, lower-right column, line 1, to page 34, upper-right column, line 9; and JP-A No. 97355/1992, page, 5, upper-left column, line 17, to page 18, lower-right column, line 20.

According to the present invention a silver halide photographic light-sensitive material that provides high sensitivity, less reduction in sensitivity upon exposure to light under high humidity and easy decoloration property in rapid processing can be provided.

EXAMPLE

Examples of the present invention will be described in the following. Nonetheless, the modes of the present invention are not limited to these examples.

Example 1

(Preparation of silver chlorobromide emulsion B1)

To a 3% lime-treated gelatin aqueous solution, was added 3.3 g of sodium chloride, followed by an aqueous solution containing 0.5 mol of silver nitrate and an aqueous solution containing 0.5 mol of sodium chloride. Then they were mixed with vigorous stirring at 66° C. Then, an aqueous solution containing 0.45 mol of silver nitrate and an aqueous solution containing 0.45 mol of sodium chloride were added to the resulting emulsion and mixed with vigorous stirring at 66° C. After that, the emulsion was desalted by washing according to a flocculation method at 40° C., and 90.0 g of a lime-treated gelatin was further added thereto. To the emulsion, was added a fine grain silver bromide emulsion, of grain size 0.05 μm, in an amount of 0.002 mol of silver, at 50° C., so that a silver bromide rich phase was formed on the surface of the silver chloride host grains. Then a sulfur sensitizer, as illustrated below, was added thereto and the emulsion was chemically sensitized at the optimum condition at 50° C. Separately, potassium hexachloroiridate (IV) had been incorporated in the above-mentioned silver bromide fine grains during their formation, in an amount of 0.8 mg per 0.005 mol of the fine grain silver bromide. Further, the resulting emulsion contained green-sensitizing dyes C and D, as illustrated below, in respective amounts of $4.0\times10^{-4}$ mol and $7.0\times10^{-5}$ mol per 1 mol of silver.

The thus obtained silver chlorobromide large size emulsion B1's grain shape, grain size, and grain size distribution were measured using an electromicroscopic photograph. As a result, the silver halide grains were of a cubic shape of grain size 0.55 μm, and 0.08 of deviation coefficient of grain size distribution. The grain size indicates an average value of each diameter of a circle having an area equivalent to the projected area of the grains. The grain size distribution (deviation coefficient) was evaluated by dividing the standard deviation of the grain size distribution by the mean grain size. Further, the AgCl content of the silver halide grains was 99.8 mol %.

(Preparation of silver chlorobromide emulsion B2)

Silver chlorobromide emulsion B2 was prepared in the same way as silver chlorobromide emulsion B1, except that the chemical sensitization was carried out optimally using the gold sensitizer as illustrated below in place of the sulfur sensitizer.

(Preparation of silver chlorobromide emulsion B3)

Silver chlorobromide emulsion B3 was prepared in the same way as silver chlorobromide emulsion B1, except that the chemical sensitization was carried out optimally using the selenium sensitizer as illustrated below in place of the sulfur sensitizer.

(Preparation of silver chlorobromide emulsion B4)

Silver chlorobromide emulsion B4 was prepared in the same way as silver chlorobromide emulsion B1, except that the chemical sensitization was carried out optimally using the tellurium sensitizer as illustrated below in place of the sulfur sensitizer.

(Preparation of silver chlorobromide emulsion B5)

Silver chlorobromide emulsion B5 was prepared in the same way as silver chlorobromide emulsion B1, except that the chemical sensitization was carried out optimally using the sulfur sensitizer and gold sensitizer.

The following compounds were used as the chemical sensitizers.

Gold sensitizer $KAuCl_4$

Selenium sensitizer

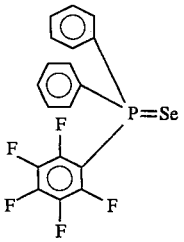

Tellurium sensitizer

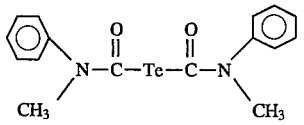

A multilayer color printing paper having the layer compositions shown below was prepared by coating various photographic constituent layers on a paper support, both surfaces of which were coated with a polyethylene laminate layer. The surface of the polyethylene laminate layer was treated by glow discharging. Then a gelatin subbing layer containing sodium dodecylbenzenesulfonate was formed thereon, prior to coating the photographic constituent layers. Coating solutions were prepared as follows:

Preparation of the third layer coating solution 16.0 g of magenta coupler (ExM), 15.0 g of image-dye stabilizer (Cpd-5), 3.0 g of image-dye stabilizer (Cpd-2), 1.0 g of image-dye stabilizer (Cpd-6), 1.0 g of image-dye stabilizer (Cpd-7), and 8.0 g of image-dye stabilizer (Cpd-8) were dissolved in 50.0 g of solvent (Solv-3), 15.0 g of solvent (Solv-4), 15.0 g of solvent (Solv-5), and 45 cc of ethyl acetate. Then the resulting solution was added to 200 cc of 20% aqueous gelatin solution containing 40 cc of 10% sodium dodecyl benzenesulfonate solution, followed by dispersion and emulsification using a high-speed stirring emulsifier, thereby prepared emulsified dispersion B.

This emulsified dispersion B and the abovedescribed silver chlorobromide emulsion B1 were mixed together and dissolved, to give the composition shown below, thereby prepared the third layer coating solution.

Coating solutions for the first, second, and fourth to seventh layers were also prepared in the same manner as the coating solution of the third layer. As a gelatin hardener for the respective layers, 1-oxy-3,5-dichloro-s-triazine sodium salt was used.

The following spectral sensitizing dyes were used in respective light-sensitive emulsion layers of the silver chlorobromide emulsion.

Blue-sensitive emulsion layer:

Sensitizing dye A

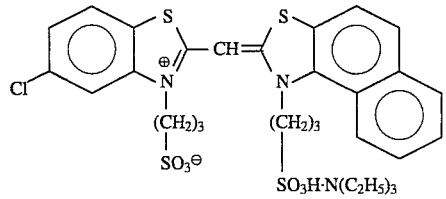

and

Sensitizing dye B

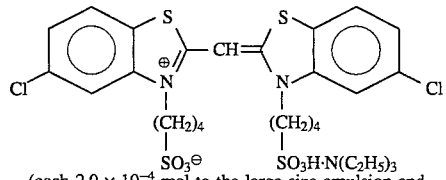

(each $2.0 \times 10^{-4}$ mol to the large size emulsion and $2.5 \times 10^{-4}$ mol to the small size emulsion, per mol of silver halide.)

Green-sensitive emulsion layer:

Sensitizing dye C

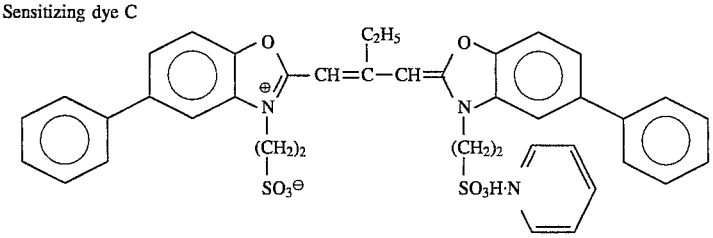

($4.0 \times 10^{-4}$ mol per mol of silver halide)

and

Sensitizing dye D

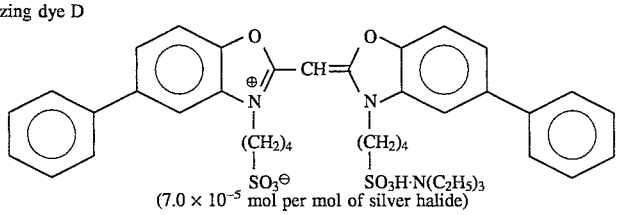

($7.0 \times 10^{-5}$ mol per mol of silver halide)

Red-sensitive emulsion layer:

Sensitizing dye E

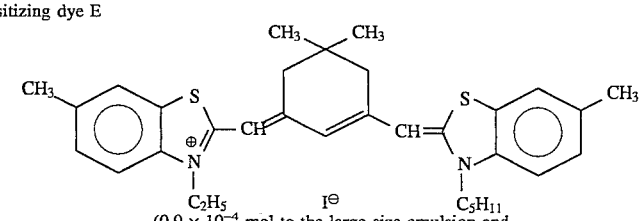

($0.9 \times 10^{-4}$ mol to the large size emulsion and $1.1 \times 10^{-4}$ mol to the small size emulsion, per mol of silver halide)

Further, Cpd-14 and Cpd-15 were respectively added, into each layer, in such amount that the respective total amount becomes 25.0 mg/m$^2$ and 50 mg/m$^2$.

Further, the following compound was added in an amount of $2.6\times10^{-3}$ mol per mol of silver halide:

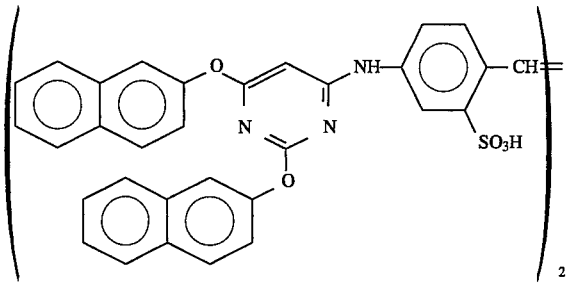

Further, 1-(5-methylureidophenyl)-5-mercaptotetrazole was added to the blue-sensitive emulsion layer, the green-sensitive emulsion layer, and the red-sensitive emulsion layer, in respective amounts of $8.5\times10^{-5}$ mol, $7.7\times10^{-4}$ mol, and $2.5\times10^{-4}$ mol, per 1 mol of silver halide.

Further, 4-hydroxy-6-methyl-1,3,3a,7-tetrazaindene was added to the blue-sensitive emulsion layer and the green-sensitive emulsion layer, in respective amounts of $1\times10^{-4}$ mol, and $2\times10^{-4}$ mol, per 1 mol of silver halide. Further, the dyes shown below were added to the emulsion layers, for the prevention of irradiation (the figure in parentheses means a coating amount).

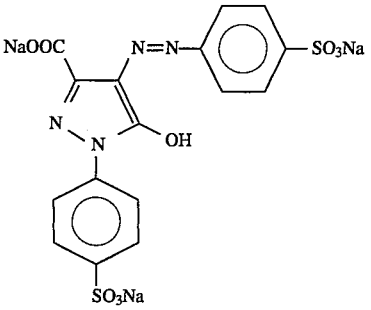

(10 mg/m²)

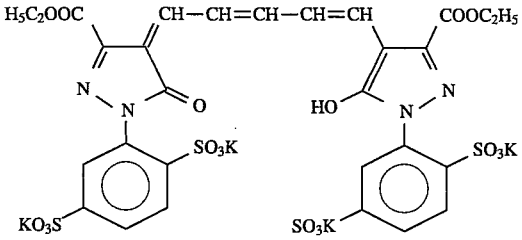

(40 mg/m²)

and

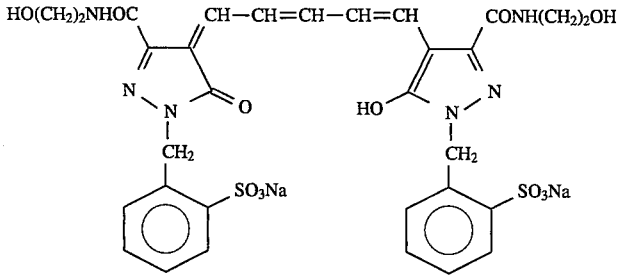

(20 mg/m²)

(Composition of Layers)

The composition of each layer is shown below. The figures represent a coating amount (g/m²). The coating amount of each silver halide emulsion is given in terms of silver.

Support

Polyethylene-laminated paper (including a white pigment ($TiO_2$) and a blue dye (ultramarine) in the polyethylene laminate at the first layer side)

| | |
|---|---|
| First Layer (Blue-sensitive emulsion layer) | |
| Silver chlorobromide emulsion A (cubic grains; 3:7 (Ag molar ratio) blend of large size emulsion A, having an average grain size of 0.88 μm, and small size emulsion A, having an average grain size of 0.70 μm, whose respective deviation coefficients of grain size distribution were 0.08 and 0.10; in each emulsion 0.3 mol % of silver bromide was located at a part of the surface of silver halide grains whose remainder was silver chloride.) | 0.27 |
| Gelatin | 1.36 |
| Yellow coupler (EXY) | 0.79 |
| Dye-image stabilizer (Cpd-1) | 0.08 |
| Dye-image stabilizer (Cpd-2) | 0.04 |
| Dye-image stabilizer (Cpd-3) | 0.08 |
| Solvent (Solv-1) | 0.13 |
| Solvent (Solv-2) | 0.13 |
| Second Layer (Color-mixing-preventing layer) | |
| Gelatin | 1.00 |
| Color mix inhibitor (Cpd-4) | 0.06 |
| Solvent (Solv-7) | 0.03 |
| Solvent (Solv-2) | 0.25 |

-continued

| | |
|---|---|
| Solvent (Solv-3) | 0.25 |
| Third Layer (Green-sensitive emulsion layer) | |

-continued

| | |
|---|---|
| Silver chlorobromide emulsion B1 | 0.13 |
| Gelatin | 1.45 |
| Magenta coupler (EXM) | 0.16 |
| Dye-image stabilizer (Cpd-5) | 0.15 |
| Dye-image stabilizer (Cpd-2) | 0.03 |
| Dye-image stabilizer (Cpd-6) | 0.01 |
| Dye-image stabilizer (Cpd-7) | 0.01 |
| Dye-image stabilizer (Cpd-8) | 0.08 |
| Solvent (Solv-3) | 0.50 |
| Solvent (Soly-4) | 0.15 |
| Solvent (Solv-5) | 0.15 |
| Fourth Layer (Color-mixing-preventing layer) | |
| Gelatin | 0.70 |
| Color mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion C (cubic grains; 1:4 (Ag molar ratio) blend of large size emulsion C, having an average grain size of 0.50 μm, and small size emulsion C, having an average grain size of 0.41 μm, whose respective deviation coefficients of grain size distribution were 0.09 and 0.11; in each emulsion 0.8 mol % of silver bromide was located at a part of the surface of silver halide grains whose remainder was silver chloride.) | 0.20 |
| Gelatin | 0.85 |
| Cyan coupler (EXC) | 0.33 |
| Ultraviolet absorbent (UV-2) | 0.18 |
| Dye-image stabilizer (Cpd-9) | 0.01 |
| Dye-image stabilizer (Cpd-10) | 0.01 |
| Dye-image stabilizer (Cpd-11) | 0.01 |
| Solvent (Solv-6) | 0.22 |
| Dye-image stabilizer (Cpd-8) | 0.11 |
| Dye-image stabilizer (Cpd-6) | 0.11 |
| Solvent (Solv-1) | 0.11 |

-continued

| | |
|---|---|
| Dye-image stabilizer (Cpd-1) | 0.33 |
| Sixth Layer (Ultraviolet absorbing layer) | |
| Gelatin | 0.55 |
| Ultraviolet absorbent (UV-1) | 0.38 |
| Dye-image stabilizer (Cpd-12) | 0.15 |
| Dye-image stabilizer (Cpd-5) | 0.02 |
| Seventh Layer (Protective layer) | |
| Gelatin | 1.13 |
| Acryl modified copolymer of polyvinyl alcohol (modification degree: 17%) | 0.05 |
| Liquid paraffin | 0.02 |
| Dye-image stabilizer (Cpd-13) | 0.01 |

Compound used are illustrated below.

(ExY) Yellow coupler

Mixture ((a):(b)=1:1 in molar ratio) of (a)

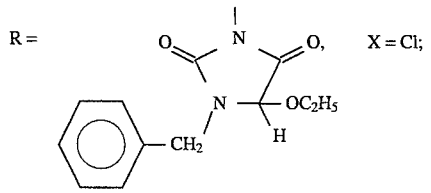

(b)

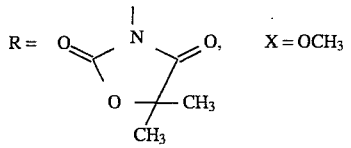

of the following formula

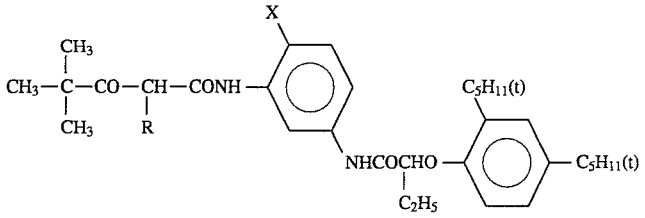

(ExM) Magenta coupler

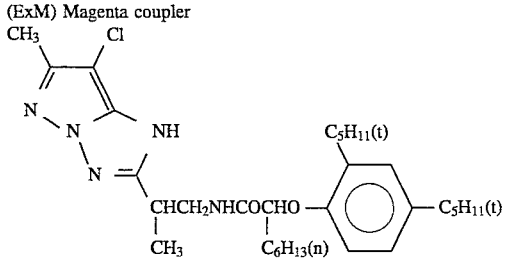

(ExC) Cyan coupler

Mixture (3:7 in molar ratio) of

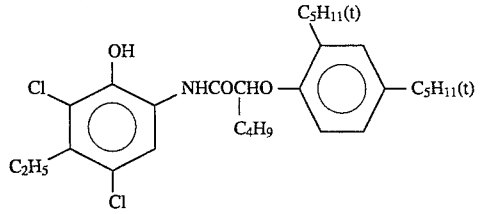

and

-continued
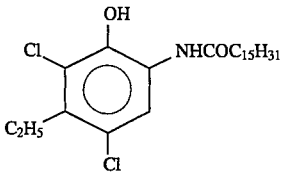
(Cpd-1) Image-dye stabilizer
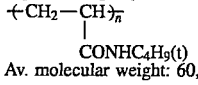
Av. molecular weight: 60,000
(Cpd-2) Image-dye stabilizer
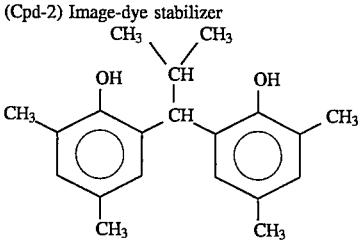
(Cpd-3) Image-dye stabilizer
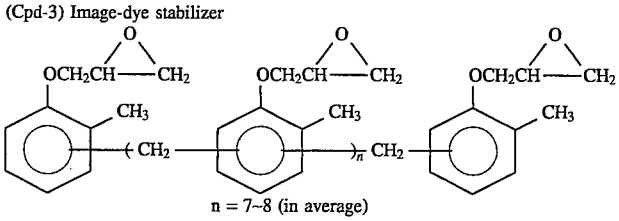
n = 7~8 (in average)
(Cpd-4) Color-mix inhibitor
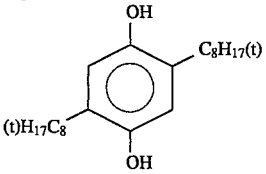
(Cpd-5) Image-dye stabilizer
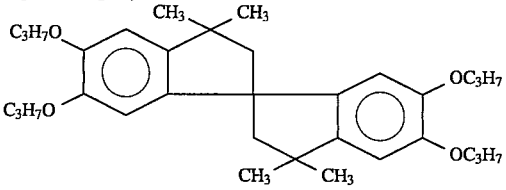
(Cpd-6) Image-dye stabilizer
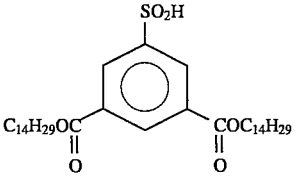
(Cpd-7) Image-dye stabilizer
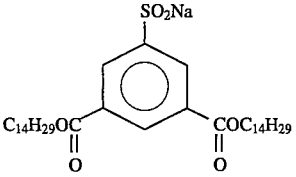
(Cpd-8) Image-dye stabilizer -continued
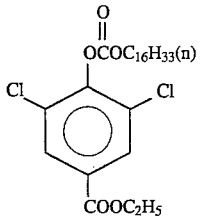
(Cpd-9) Image-dye stabilizer
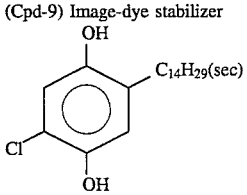
(Cpd-10) Image-dye stabilizer
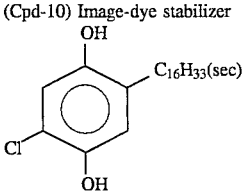
(Cpd-11) Image-dye stabilizer
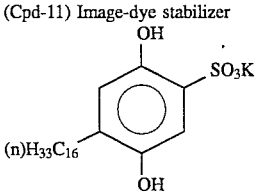
(Cpd-12) Image-dye stabilizer
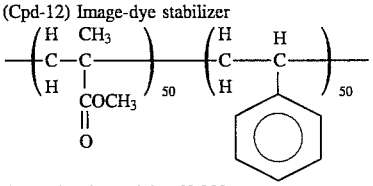
Av. molecular weight: 60,000
(Cpd-13) Image-dye stabilizer
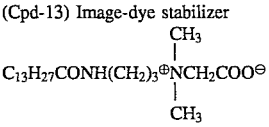
(Cpd-14) Antiseptic
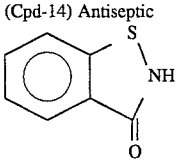
(Cpd-15) Antiseptic
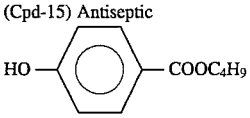
(UV-1) Ultraviolet ray absorber Mixture of (i), (ii), (iii), and (iv) (1:5:10:5 in weight ratio)

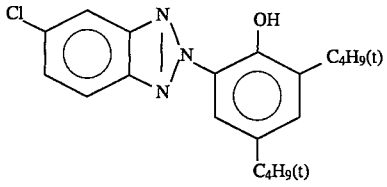

(i)

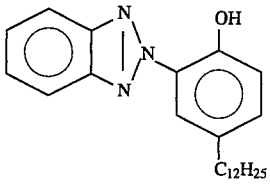

(ii)

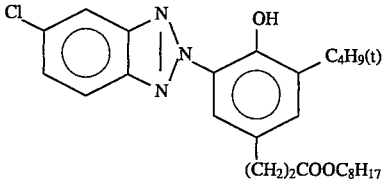

(iii)

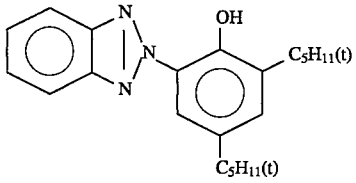

(iv)

(UV-2) Ultraviolet ray absorber

Mixture of (v), (vi), and (vii) (1:2:2 in weight ratio)

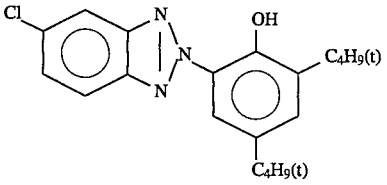

(v)

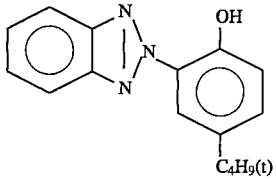

(Vi)

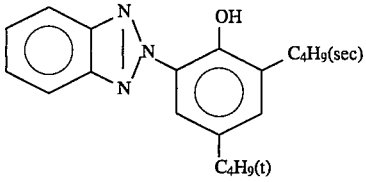

(vii)

(Solv-1) Solvent

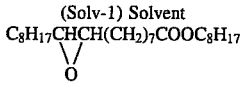

(Solv-2) Solvent

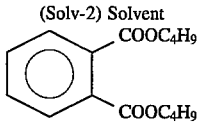

(Solv-3) Solvent

-continued

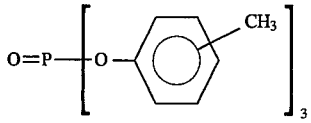

(Solv-4) Solvent

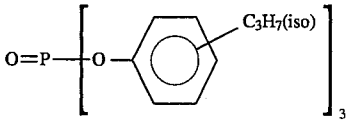

(Solv-5) Solvent

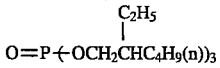

(Solv-6) Solvent

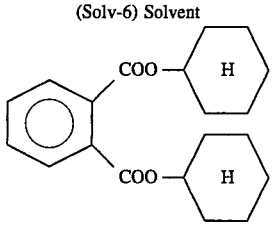

(Solv-7) Solvent

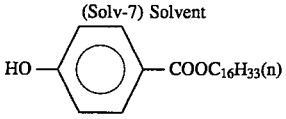

Coating samples 102 to 105, the light-sensitive material having the above-mentioned layer composition (sample 101), were prepared in the same manner, except that the silver halide emulsion contained in the green-sensitive emulsion layer was changed to Emulsions B2, B3, B4 and B5, respectively Furthermore, samples 201 to 515, similar to samples 101 to 105, were prepared in the same manner, except that additives as shown in Table 2 were added to the thus obtained samples 101 to 105. The additives were added to the second layer and the fourth layer (each color mix-preventing layer). However, it was identified by photographing a cross section of these samples that these additives did not remain in these two added layers but diffused into all layers during a coating process, and thereby approximately uniformly existed in the all layers.

Moreover, coating samples 601 to 615 were prepared in the same manner as samples 101 to 105, except that the samples 601 to 615 each had a zero layer formed, by coating, under the first layer, a dispersion solution containing a dye dispersion prepared as mentioned below. (Preparation of dye dispersion)

First, 1.0 g of Compound B was added to 5 ml of 5% aqueous surfactant solution, and then mixed and ground with a sand mill. Next, the resulting mixture was dispersed in 25 ml of 10% aqueous lime-treated gelatin solution containing 1 g of citric acid, and then the sand used was removed by a glass filter. The dye adsorbed to sand on the glass filter was washed away with warm water, and the resulting dye solution was added to the main dye dispersion solution, thereby yielding 1400 ml of a dye dispersion solution containing 7% gelatin.

| Layer constitution of Samples 601 to 605 (the figure represents a coating amount ($g/m^2$)) | |
|---|---|
| Zero Layer (Irradiation-preventing layer) | |
| Gelatin | 1.00 |
| Dye (Compound B) | 10.00 ($mg/m^2$) |

The layer composition of the first layer to the seventh layer is the same as that of samples 101 to 515.

Furthermore, samples 606 to 615 were prepared in the same manner as samples 601 to 605, except that a coating amount of Compound B was changed as shown below.

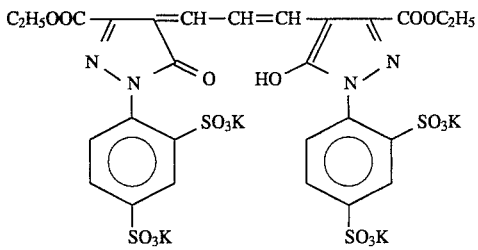

Compound A

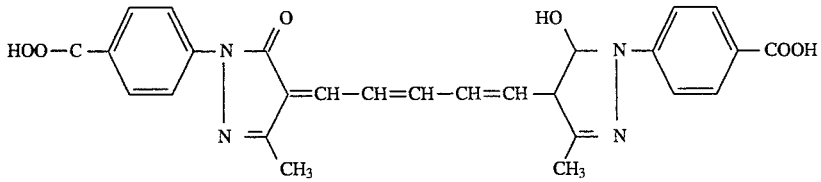

Compound B

TABLE 2

| Sample No. | Emulsion in the 3rd layer | Compound added in the 2nd, 4th layers | Total added amounts of the compound in the 2nd, 4th layers ($mol/m^2$) | Remarks |
|---|---|---|---|---|
| 101 | B1 | — | — | Comparative Example |
| 102 | B2 | — | — | " |
| 103 | B3 | — | — | " |
| 104 | B4 | — | — | " |
| 105 | B5 | — | — | " |
| 201 | B1 | Compound A | $4.0 \times 10^{-6}$ | Comparative Example |
| 202 | B2 | " | " | " |
| 203 | B3 | " | " | " |
| 204 | B4 | " | " | " |
| 205 | B5 | " | " | " |
| 206 | B1 | " | $2.0 \times 10^{-5}$ | " |
| 207 | B2 | " | " | " |
| 208 | B3 | " | " | " |
| 209 | B4 | " | " | " |
| 210 | B5 | " | " | " |
| 211 | B1 | " | $7.0 \times 10^{-5}$ | " |
| 212 | B2 | " | " | " |
| 213 | B3 | " | " | " |
| 214 | B4 | " | " | " |
| 215 | B5 | " | " | " |
| 301 | B1 | (70) | $4.0 \times 10^{-6}$ | Comparative Example |
| 302 | B2 | " | " | This Invention |
| 303 | B3 | " | " | " |
| 304 | B4 | " | " | " |
| 305 | B5 | " | " | " |
| 306 | B1 | " | $2.0 \times 10^{-5}$ | Comparative Example |
| 307 | B2 | " | " | This Invention |
| 308 | B3 | " | " | " |
| 309 | B4 | " | " | " |
| 310 | B5 | " | " | " |
| 311 | B1 | " | $7.0 \times 10^{-5}$ | Comparative Example |
| 312 | B2 | " | " | This Invention |
| 313 | B3 | " | " | " |
| 314 | B4 | " | " | " |
| 315 | B5 | " | " | " |
| 401 | B1 | 89 | $4.0 \times 10^{-6}$ | Comparative Example |
| 402 | B2 | " | " | This Invention |
| 403 | B3 | " | " | " |
| 404 | B4 | " | " | " |
| 405 | B5 | " | " | " |
| 406 | B1 | " | $2.0 \times 10^{-5}$ | Comparative Example |
| 407 | B2 | " | " | This Invention |

TABLE 2-continued

| Sample No. | Emulsion in the 3rd layer | Compound added in the 2nd, 4th layers | Total added amounts of the compound in the 2nd, 4th layers (mol/m$^2$) | Remarks |
|---|---|---|---|---|
| 408 | B3 | " | " | " |
| 409 | B4 | " | " | " |
| 410 | B5 | " | " | " |
| 411 | B1 | " | $7.0 \times 10^{-5}$ | Comparative Example |
| 412 | B2 | " | " | This Invention |
| 413 | B3 | " | " | " |
| 414 | B4 | " | " | " |
| 415 | B5 | " | " | " |
| 501 | B1 | (11) | $4.0 \times 10^{-6}$ | Comparative Example |
| 502 | B2 | " | " | This Invention |
| 503 | B3 | " | " | " |
| 504 | B4 | " | " | " |
| 505 | B5 | " | " | " |
| 506 | B1 | " | $2.0 \times 10^{-5}$ | Comparative Example |
| 507 | B2 | " | " | This Invention |
| 508 | B3 | " | " | " |
| 509 | B4 | " | " | " |
| 510 | B5 | " | " | " |
| 511 | B1 | " | $7.0 \times 10^{-5}$ | Comparative Example |
| 512 | B2 | " | " | This Invention |
| 513 | B3 | " | " | " |
| 514 | B4 | " | " | " |
| 515 | B5 | " | " | " |
| 601 | B1 | Compound B* | $2.0 \times 10^{-5}$ | Comparative Example |
| 602 | B2 | " | " | " |
| 603 | B3 | " | " | " |
| 604 | B4 | " | " | " |
| 605 | B5 | " | " | " |
| 606 | B1 | " | $7.0 \times 10^{-5}$ | " |
| 607 | B2 | " | " | " |
| 608 | B3 | " | " | " |
| 609 | B4 | " | " | " |
| 610 | B5 | " | " | " |
| 611 | B1 | " | $2.0 \times 10^{-4}$ | " |
| 612 | B2 | " | " | " |
| 613 | B3 | " | " | " |
| 614 | B4 | " | " | " |
| 615 | B5 | " | " | " |

Note:
Compounds A and B were Comparative Compounds outside of the present invention.
Compounds (11), (70), (89) were those in the above list of compound Sample Nos. 1 to 104 of the present invention.
*Compound B was added in the Zero layer.

The thus obtained coating samples 101 to 615 were subjected to the following evaluation test, in order to examine their photographic properties.

First, each of the coating samples was gradation-exposed to green light through an optical wedge for sensitometry and a green filter by using a sensitometer (FWH model, manufactured by Fuji Photo Film Co., Ltd.; color temperature of the light source:3200K), in an exposure quantity of 200 CMS for 1/10 second of exposure time.

In this test, one exposure was carried out in an atmosphere of 25° C.-50% RH, as a standard condition, and another exposure was carried out at 25° C.-85% RH, as a condition under high humidity.

The coating samples were then subjected to color development processing as shown below.

Processing Steps

| Step | Temperature | Time |
|---|---|---|
| Color development | 35° C. | 45 sec |
| Bleach-fixing | 35° C. | 45 sec |
| Rinse (1) | 28~35° C. | 30 sec |
| Rinse (2) | 28~35° C. | 30 sec |
| Rinse (3) | 28~35° C. | 30 sec |

-continued

Processing Steps

| Step | Temperature | Time |
|---|---|---|
| Drying | 70~80° C. | 60 sec |

Color developer

| | |
|---|---|
| Triethanolamine | 8.12 g |
| N,N-diethylhydroxylamine | 4.93 g |
| Fluorescent whitening agent (UVITEX CK made by Ciga Geigy) | 2.80 g |
| 4-Amino-3-methyl-N-ethyl-N-[β-(methanesulfonamide)ethyl]-p-phenylenediamine sulfate | 4.96 g |
| Sodium sulfite | 0.13 g |
| Potassium carbonate | 18.40 g |
| Potassium hydrogen carbonate | 4.85 g |
| EDTA.2Na.2$H_2O$ | 2.20 g |
| Sodium chloride | 1.36 g |
| Water to make | 1,000 ml |
| pH | 10.05 |

Bleach-fixing solution

| | |
|---|---|
| Ammonium thiosulfate (54 wt %) | 103.0 ml |

-continued

| | |
|---|---|
| $NH_4$[EDTA.Fe] | 54.10 mg |
| Sodium sulfite | 16.71 g |
| Gracial acetic acid | 8.61 g |
| Water to make | 1,000 ml |
| pH | 5.44 |

Each of the exposed to light and color-developed samples 101 to 615 was subjected to sensitometry, in order to measure the light amount (E) required to give 1.0 of magenta optical density. Each sensitivity of the samples was defined as the logarithm (S) of the reciprocal of each light amount.

Furthermore, a change of sensitivity due to a change of humidity upon exposure to light of the light-sensitive material was indicated as $\Delta S$ ($=S_{50}-S_{85}$), i.e., a sensitivity difference between Sensitivity $S_{50}$, when exposed at the atmosphere of 25° C.-50% RH, and Sensitivity $S_{85}$, when exposed at the atmosphere of 25° C.-85% RH.

Moreover, in order to evaluate a remaining color after color development processing of the light-sensitive material, $\Delta D^{M}_{min}$ was evaluated; this is the difference between the magenta density ($D^{M}_{min}$), obtained by color developing each of the unexposed light-sensitive materials 201 to 615, and the magenta density ($D^{M}_{min}$), obtained by color developing each of the unexposed same materials as the materials 201 to 615, expect for the absence of the additive in the magenta color-developable layer. The remaining color after color development processing is meant to be less, as the value of $\Delta D^{M}_{min}$ is smaller.

The results thus obtained are shown in Table 3.

TABLE 3

| Sample No. | Sensitivity (S) | ΔS | $\Delta D^{M}_{min}$ | Remarks |
|---|---|---|---|---|
| 101 | 2.20 | 0.07 | — | Comparative Example |
| 102 | 2.50 | 0.10 | — | " |
| 103 | 2.30 | 0.11 | — | " |
| 104 | 2.30 | 0.12 | — | " |
| 105 | 2.60 | 0.07 | — | " |
| 201 | 2.00 | 0.05 | 0.007 | Comparative Example |
| 202 | 2.30 | 0.08 | " | " |
| 203 | 2.20 | 0.09 | " | " |
| 204 | 2.15 | 0.08 | " | " |
| 205 | 2.25 | 0.08 | " | " |
| 206 | 1.70 | 0.04 | 0.030 | " |
| 207 | 2.00 | 0.05 | " | " |
| 208 | 1.90 | 0.05 | " | " |
| 209 | 1.85 | 0.06 | " | " |
| 210 | 2.00 | 0.05 | " | " |
| 211 | 1.50 | 0.04 | 0.040 | " |
| 212 | 1.80 | 0.04 | " | " |
| 213 | 1.70 | 0.04 | " | " |
| 214 | 1.65 | 0.04 | " | " |
| 215 | 1.80 | 0.04 | " | " |
| 301 | 2.05 | 0.05 | 0.003 | Comparative Example |
| 302 | 2.35 | 0.02 | " | This Invention |
| 303 | 2.20 | 0.02 | " | " |
| 304 | 2.20 | 0.02 | " | " |
| 305 | 2.45 | 0.06 | " | " |
| 306 | 1.70 | 0.04 | 0.005 | Comparative Example |
| 307 | 2.05 | 0.01 | " | This Invention |
| 308 | 1.95 | 0.01 | " | " |
| 309 | 1.90 | 0.02 | " | " |
| 310 | 2.15 | 0.01 | " | " |
| 311 | 1.50 | 0.01 | 0.007 | Comparative Example |
| 312 | 1.85 | 0.00 | " | This Invention |
| 313 | 1.75 | 0.00 | " | " |
| 314 | 1.70 | 0.00 | " | " |
| 315 | 1.95 | −0.01 | " | " |
| 401 | 2.05 | 0.05 | 0.002 | Comparative Example |
| 402 | 2.30 | 0.02 | " | This Invention |
| 403 | 2.20 | 0.02 | " | " |
| 404 | 2.15 | 0.02 | " | " |
| 405 | 2.35 | 0.02 | " | " |

TABLE 3-continued

| Sample No. | Sensitivity (S) | ΔS | $\Delta D^{M}_{min}$ | Remarks |
|---|---|---|---|---|
| 406 | 1.75 | 0.04 | 0.004 | Comparative Example |
| 407 | 2.00 | 0.00 | " | This Invention |
| 408 | 1.95 | 0.01 | " | " |
| 409 | 1.90 | 0.00 | " | " |
| 410 | 2.10 | 0.00 | " | " |
| 411 | 1.55 | 0.00 | 0.006 | Comparative Example |
| 412 | 1.80 | 0.00 | " | This Invention |
| 413 | 1.75 | −0.01 | " | " |
| 414 | 1.70 | 0.00 | " | " |
| 415 | 1.90 | −0.01 | " | " |
| 501 | 2.10 | 0.05 | 0.002 | Comparative Example |
| 502 | 2.35 | 0.01 | " | This Invention |
| 503 | 2.20 | 0.01 | " | " |
| 504 | 2.20 | 0.00 | " | " |
| 505 | 2.45 | 0.04 | " | " |
| 506 | 1.80 | 0.04 | 0.003 | Comparative Example |
| 507 | 2.05 | −0.01 | " | This Invention |
| 508 | 2.00 | 0.00 | " | " |
| 509 | 1.95 | 0.00 | " | " |
| 510 | 2.15 | 0.00 | " | " |
| 511 | 1.60 | −0.01 | 0.005 | Comparative Example |
| 512 | 1.85 | 0.00 | " | This Invention |
| 513 | 1.80 | 0.00 | " | " |
| 514 | 1.75 | 0.00 | " | " |
| 515 | 1.95 | 0.00 | " | " |
| 601 | 2.00 | 0.05 | 0.010 | Comparative Example |
| 602 | 2.30 | 0.08 | " | " |
| 603 | 2.25 | 0.09 | " | " |
| 604 | 2.20 | 0.09 | " | " |
| 605 | 2.35 | 0.09 | " | " |
| 606 | 1.70 | 0.04 | 0.035 | " |
| 607 | 2.00 | 0.05 | " | " |
| 608 | 1.95 | 0.06 | " | " |
| 609 | 1.85 | 0.06 | " | " |
| 610 | 2.15 | 0.05 | " | " |
| 611 | 1.55 | 0.04 | 0.050 | " |
| 612 | 1.85 | 0.05 | " | " |
| 613 | 1.70 | 0.05 | " | " |
| 614 | 1.70 | 0.06 | " | " |
| 615 | 1.85 | 0.05 | " | " |

As is apparent from the results shown in Table 3, it is found that the combination use of the gold-, selenium-, or tellurium-sensitized silver halide emulsion and the dye, each according to the present invention, provides a lower reduction in sensitivity upon exposure to light, even under high humidity, and also a less remaining color after rapid processing, as seen in the coating samples 302 to 305, 307 to 310, 312 to 315, 402 to 405, 407 to 410, 412 to 415, 502 to 505, 507 to 510, and 512 to 515.

Further, it is found that the above-mentioned effects are more marked when a larger amount of the dye according to the present invention was used.

Furthermore, it is found that, of the dyes according to the present invention, it is more effective to use Dye 89, having no dissociating group such as of $R_1$, $R_2$, $R_3$ and $R_4$ in general formula (I), and moreover Dye 11, which is within the definition of $R_3$ and $R_4$ in general formula (I) being represented by general formula (II).

On the other hand, it is found that the combined use of the gold-, selenium- or tellurium-sensitized silver halide emulsion according to the present invention, and the dye that is outside of the present invention, provides smaller effects, as seen in samples 202 to 205, 207 to 210 and 212 to 215. Furthermore, it is found that the combined use of the silver halide emulsion that is outside of the present invention, and the dye according to the present invention, also provides smaller effects, as seen in samples 301, 306, 311, 401, 406, 411, 501, 506 and 511.

Moreover, to incorporate a dye dispersion into the light-sensitive material, and also to use the silver halide emulsion according to the present invention, were not very effective for minimizing both the reduction in sensitivity upon exposure to light under high humidity and the remaining color after the rapid processing, as seen in samples 602 to 605, 607 to 610 and 612 to 615.

Example 2

Samples were prepared in the same manner as the samples used in Example 1, except for changing the pH value of the coated film according to the method as described in the specification. Adjustment of the pH values of the coated film of Samples was carried out by adjusting the pH values of the prepared fourth layer coating solution for the photographic light-sensitive materials in Example 1. Then the thus prepared samples were subjected to the same evaluation test as described in Example 1. The results thus obtained are shown in Table 4.

TABLE 4

| Sample No. | pH value of the coated film | Sensitivity (S) | ΔS | $\Delta D^{M}_{min}$ | Remarks |
|---|---|---|---|---|---|
| 101 | 6.2 | 2.20 | 0.07 | — | Comparative Example |
| 101' | 7.0 | 2.20 | 0.10 | — | " |
| 101" | 5.5 | 2.20 | 0.06 | — | " |
| 102 | 6.2 | 2.50 | 0.10 | — | " |
| 102' | 7.0 | 2.50 | 0.13 | — | " |
| 102" | 5.5 | 2.50 | 0.09 | — | " |
| 103 | 6.2 | 2.30 | 0.08 | — | " |
| 103' | 7.0 | 2.30 | 0.11 | — | " |
| 103" | 5.5 | 2.30 | 0.07 | — | " |
| 104 | 6.2 | 2.30 | 0.12 | — | " |
| 104' | 7.0 | 2.30 | 0.16 | — | " |
| 104" | 5.5 | 2.30 | 0.11 | — | " |
| 105 | 6.2 | 2.60 | 0.10 | — | " |
| 105' | 7.0 | 2.60 | 0.13 | — | " |
| 105" | 5.5 | 2.60 | 0.09 | — | " |
| 206 | 6.2 | 1.70 | 0.04 | 0.030 | Comparative Example |
| 206' | 7.0 | 1.70 | 0.06 | 0.030 | " |
| 206" | 5.5 | 1.70 | 0.04 | 0.025 | " |
| 207 | 6.2 | 2.00 | 0.05 | 0.030 | " |
| 207' | 7.0 | 2.05 | 0.08 | 0.030 | " |
| 207" | 5.5 | 2.00 | 0.04 | 0.025 | " |
| 208 | 6.2 | 1.90 | 0.05 | 0.030 | " |
| 208' | 7.0 | 1.90 | 0.08 | 0.030 | " |
| 208" | 5.5 | 1.90 | 0.03 | 0.030 | " |
| 209 | 6.2 | 1.85 | 0.06 | 0.030 | " |
| 209' | 7.0 | 1.85 | 0.09 | 0.030 | " |
| 209" | 5.5 | 1.85 | 0.05 | 0.025 | " |
| 210 | 6.2 | 2.00 | 0.05 | 0.030 | " |
| 210' | 7.0 | 2.00 | 0.08 | 0.030 | " |
| 210" | 5.5 | 2.00 | 0.04 | 0.025 | " |
| 306 | 6.2 | 1.70 | 0.04 | 0.005 | Comparative Example |
| 306' | 7.0 | 1.70 | 0.07 | 0.005 | " |
| 306" | 5.5 | 1.70 | 0.04 | 0.004 | " |
| 307 | 6.2 | 2.05 | 0.01 | 0.005 | This Invention |
| 307' | 7.0 | 2.05 | 0.03 | 0.006 | " |
| 307" | 5.5 | 2.05 | 0.00 | 0.004 | " |
| 308 | 6.2 | 1.95 | 0.01 | 0.005 | " |
| 308' | 7.0 | 1.95 | 0.03 | 0.005 | " |
| 308" | 5.5 | 1.95 | 0.00 | 0.004 | " |
| 309 | 6.2 | 1.90 | 0.02 | 0.005 | " |
| 309' | 7.0 | 1.90 | 0.03 | 0.006 | " |
| 309" | 5.5 | 1.90 | 0.01 | 0.004 | " |
| 310 | 6.2 | 2.15 | 0.01 | 0.005 | " |
| 310' | 7.0 | 2.15 | 0.03 | 0.006 | " |
| 310" | 5.5 | 2.15 | 0.00 | 0.004 | " |
| 406 | 6.2 | 1.75 | 0.04 | 0.004 | Comparative Example |
| 406' | 7.0 | 1.80 | 0.06 | 0.004 | " |
| 406" | 5.5 | 1.75 | 0.03 | 0.003 | " |
| 407 | 6.2 | 2.00 | 0.00 | 0.004 | This Invention |
| 407' | 7.0 | 2.00 | 0.02 | 0.004 | " |
| 407" | 5.5 | 2.00 | 0.00 | 0.003 | " |
| 408 | 6.2 | 1.95 | 0.01 | 0.004 | " |
| 408' | 7.0 | 1.95 | 0.03 | 0.004 | " |
| 408" | 5.5 | 1.95 | 0.01 | 0.003 | " |
| 409 | 6.2 | 1.90 | 0.00 | 0.004 | " |
| 409' | 7.0 | 1.90 | 0.02 | 0.004 | " |
| 409" | 5.5 | 1.90 | 0.00 | 0.003 | " |
| 410 | 6.2 | 2.10 | 0.00 | 0.004 | " |
| 410' | 7.0 | 2.10 | 0.02 | 0.004 | " |
| 410" | 5.5 | 2.10 | 0.00 | 0.003 | " |
| 506 | 6.2 | 1.80 | 0.04 | 0.003 | Comparative Example |
| 506' | 7.0 | 1.80 | 0.07 | 0.003 | " |
| 506" | 5.5 | 1.80 | 0.04 | 0.003 | " |
| 507 | 6.2 | 2.05 | −0.01 | 0.003 | This Invention |
| 507' | 7.0 | 2.00 | 0.01 | 0.004 | " |
| 507" | 5.5 | 2.05 | 0.00 | 0.003 | " |
| 508 | 6.2 | 2.00 | 0.00 | 0.003 | " |
| 508' | 7.0 | 2.00 | 0.01 | 0.003 | " |

TABLE 4-continued

| Sample No. | pH value of the coated film | Sensitivity (S) | ΔS | $\Delta D^{M}_{min}$ | Remarks |
|---|---|---|---|---|---|
| 508" | 5.5 | 2.00 | 0.00 | 0.003 | " |
| 509 | 6.2 | 1.95 | −0.01 | 0.003 | " |
| 509' | 7.0 | 1.90 | 0.01 | 0.003 | " |
| 509" | 5.5 | 1.95 | 0.00 | 0.003 | " |
| 510 | 6.2 | 2.15 | −0.01 | 0.003 | " |
| 510' | 7.0 | 2.15 | 0.01 | 0.004 | " |
| 510" | 5.5 | 2.15 | 0.00 | 0.003 | " |
| 606 | 6.2 | 1.70 | 0.04 | 0.035 | Comparative Example |
| 606' | 7.0 | 1.70 | 0.07 | 0.040 | " |
| 606" | 5.5 | 1.70 | 0.04 | 0.035 | " |
| 607 | 6.2 | 2.00 | 0.05 | 0.035 | " |
| 607' | 7.0 | 2.00 | 0.08 | 0.035 | " |
| 607" | 5.5 | 2.05 | 0.04 | 0.030 | " |
| 608 | 6.2 | 1.95 | 0.06 | 0.035 | " |
| 608' | 7.0 | 1.95 | 0.09 | 0.035 | " |
| 608" | 5.5 | 1.90 | 0.06 | 0.030 | " |
| 609 | 6.2 | 1.85 | 0.06 | 0.035 | " |
| 609' | 7.0 | 1.85 | 0.09 | 0.035 | " |
| 609" | 5.5 | 1.80 | 0.05 | 0.030 | " |
| 610 | 6.2 | 2.15 | 0.05 | 0.035 | " |
| 610' | 7.0 | 2.15 | 0.08 | 0.030 | " |
| 610" | 5.5 | 2.15 | 0.05 | 0.035 | " |

As is apparent from the results shown in Table 4, it is found that making the pH value of the coated film 6.5 or less is much more effective for minimizing both the reduction in sensitivity upon exposure to light under high humidity and the remaining color after rapid processing.

While the invention has been described in detail and with reference to specific embodiments thereof, it will be apparent to one skilled in the art that various changes and modifications can be made therein without departing from the spirit and scope thereof.

What we claim is:

1. A silver halide photographic light-sensitive material comprising, at least, a silver halide emulsion layer on a support, wherein at least one layer of the silver halide emulsion layers contains silver halide grains that have a silver chloride content of 95 mol % or more and are subject to selenium, tellurium, or gold sensitization, and wherein the photographic material further comprises a dye represented by formula (I) in a molecular dispersion state:

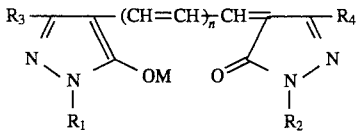

(I)

wherein $R_1$, $R_2$, $R_3$, and $R_4$ each represent a hydrogen atom or a substituent, with the proviso that the total atomic weight of at least one of ($R_1$+$R_3$) and ($R_2$+$R_4$) is no more than 160; n is 0, 1 or 2; and M represents an alkali metal.

2. A silver halide photographic light-sensitive material as claimed in claim 1, wherein the above-said silver halide emulsion layer is a cyan, magenta or yellow color-developable layer.

3. The silver halide photographic light-sensitive material as claimed in claim 1, wherein none of the substituent $R_1$, $R_2$, $R_3$ and $R_4$ in formula (I) has a dissociating group.

4. The silver halide photographic light-sensitive material as claimed in claim 3, wherein the substituent $R_1$, $R_2$, $R_3$ and $R_4$ each do not have a sulfonic acid group, a carboxyl group or a phosphoric acid group.

5. The silver halide photographic light-sensitive material as claimed in claim 1, wherein the pH value of the coated film of the photographic material is no more than 6.5.

6. The silver halide photographic light-sensitive material as claimed in claim 5, wherein the pH value of the coated film of the photographic material ranges from 4.0 to 6.0.

7. The silver halide photographic light-sensitive material as claimed in claim 1, wherein $R_3$ and $R_4$ in formula (I) each stand for a substituent represented by formula (II):

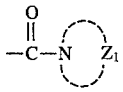

formula (II)

wherein $Z_1$ represents an atomic group required to form a 5- or 6-membered saturated heterocyclic ring with a nitrogen atom.

8. The silver halide photographic light-sensitive material as claimed in claim 1, wherein the selenium or tellurium sensitization is carried out with a selenium or tellurium sensitizing agent in an amount of about $10^{-8}$ mol to $10^{-2}$ mol per 1 mol of silver halide.

9. The silver halide photographic light-sensitive material as claimed in claim 1, wherein the gold sensitization is carried out with a gold sensitizing agent in an amount of about $10^{-7}$ mol to $10^{-2}$ mol per 1 mol of silver halide.

10. The silver halide photographic light-sensitive material as claimed in claim 1, wherein the total atomic weight of each of ($R_1$+$R_3$) and ($R_2$+$R_4$) is no more than 160.

11. The silver halide photographic light-sensitive material as claimed in claim 1, wherein the substituent $R_1$, $R_2$, $R_3$ and $R_4$ each represent a hydrogen atom, an alkyl group, a —$COOR_5$ group, a —$CONR_6R_7$ group, a —$CONHR_8$ group, a —$NR_9COR_{10}$ group, a —$NR_{11}R_{12}$ group, a —CN group, a —$OR_{13}$ group or a —$NR_{14}CONR_{15}R_{16}$ group, wherein $R_5$ to $R_{16}$ each represent a hydrogen atom or an unsubstituted or substituted alkyl group; $R_6$ and $R_7$, $R_{11}$ and $R_{12}$, or $R_{15}$ and $R_{16}$ may be connected with each other to form a ring.

12. The silver halide photographic light-sensitive material as claimed in claim 11, wherein $R_1$ and $R_2$ each represent a hydrogen atom or an alkyl group.

13. The silver halide photographic light-sensitive material as claimed in claim 11, wherein $R_3$ and $R_4$ each represent the —$CONR_6R_7$ group.

14. The silver halide photographic light-sensitive material as claimed in claim 1, wherein the dye is used in an amount of 0.1 mg/m$^2$ to 200 mg/m$^2$ in the photographic material.

* * * * *